US008855507B2

(12) United States Patent
Seki et al.

(10) Patent No.: US 8,855,507 B2
(45) Date of Patent: Oct. 7, 2014

(54) LUBRICANT SUPPLYING DEVICE, AND IMAGE FORMING APPARATUS

(71) Applicants: Hideyasu Seki, Chiba (JP); Satoshi Hatori, Kanagawa (JP); Naohiro Kumagai, Kanagawa (JP); Kaoru Yoshino, Tokyo (JP); Akira Fujimori, Kanagawa (JP); Ryohta Gotoh, Tokyo (JP); Nobuyuki Taguchi, Kanagawa (JP); Hiromichi Ninomiya, Kanagawa (JP); Yuta Azeyanagi, Kanagawa (JP); Yasuhito Kuboshima, Tokyo (JP)

(72) Inventors: Hideyasu Seki, Chiba (JP); Satoshi Hatori, Kanagawa (JP); Naohiro Kumagai, Kanagawa (JP); Kaoru Yoshino, Tokyo (JP); Akira Fujimori, Kanagawa (JP); Ryohta Gotoh, Tokyo (JP); Nobuyuki Taguchi, Kanagawa (JP); Hiromichi Ninomiya, Kanagawa (JP); Yuta Azeyanagi, Kanagawa (JP); Yasuhito Kuboshima, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/848,307

(22) Filed: Mar. 21, 2013

(65) Prior Publication Data

US 2013/0251381 A1 Sep. 26, 2013

(30) Foreign Application Priority Data

Mar. 21, 2012 (JP) ..... 2012-063099
Jul. 9, 2012 (JP) ..... 2012-153495

(51) Int. Cl.
*G03G 15/00* (2006.01)
*G03G 21/00* (2006.01)

(52) U.S. Cl.
CPC ..... *G03G 15/55* (2013.01); *G03G 15/553* (2013.01); *G03G 21/0094* (2013.01)
USPC ..... 399/24; 399/346

(58) Field of Classification Search
USPC ..... 399/24, 113, 346
See application file for complete search history.

(56) References Cited

U.S. PATENT DOCUMENTS

| | | | | |
|---|---|---|---|---|
| 8,577,257 | B2 * | 11/2013 | Arai et al. | 399/113 |
| 2007/0059067 | A1 | 3/2007 | Tanaka et al. | |
| 2007/0172273 | A1 | 7/2007 | Harada et al. | |
| 2007/0258743 | A1 | 11/2007 | Shakuto et al. | |
| 2008/0181689 | A1 | 7/2008 | Fujimori | |
| 2009/0060600 | A1 | 3/2009 | Ninomiya et al. | |
| 2009/0103944 | A1 | 4/2009 | Shintani et al. | |
| 2009/0120356 | A1 | 5/2009 | Karasawa et al. | |

(Continued)

FOREIGN PATENT DOCUMENTS

| | | |
|---|---|---|
| JP | 08-314346 | 11/1996 |
| JP | 2010-271665 | 12/2010 |
| JP | 2011-197126 | 10/2011 |

OTHER PUBLICATIONS

U.S. Appl. No. 13/790,017, filed Mar. 8, 2013, Hatori, et al.

(Continued)

*Primary Examiner* — Hoang Ngo
(74) *Attorney, Agent, or Firm* — Oblon, Spivak, McClelland, Maier & Neustadt, L.L.P.

(57) ABSTRACT

In the present invention, a lubricant supplying device includes a lubricant end determining unit that determines that a solid lubricant is in an end state when the amount of a lubricant supplying operation reaches a threshold after a residual amount detecting unit detects that the residual amount of the solid lubricant is equal to or smaller than a predetermined amount. The lubricant end determining unit makes a threshold of the amount of the lubricant supplying operation at temperature or humidity of equal to or lower than a predetermined value lower than a threshold of the amount of the lubricant supplying operation at temperature or humidity of higher than the predetermined value.

19 Claims, 13 Drawing Sheets

(56) References Cited

U.S. PATENT DOCUMENTS

| | | | |
|---|---|---|---|
| 2010/0183349 | A1 | 7/2010 | Shintani et al. |
| 2011/0076075 | A1 | 3/2011 | Arai et al. |
| 2011/0123239 | A1 | 5/2011 | Azeyanagi et al. |
| 2011/0170908 | A1 | 7/2011 | Saitoh et al. |
| 2011/0217101 | A1 | 9/2011 | Okamoto et al. |
| 2011/0229232 | A1 | 9/2011 | Kojima et al. |
| 2012/0195661 | A1 | 8/2012 | Karasawa et al. |

OTHER PUBLICATIONS

U.S. Appl. No. 13/827,444, filed Mar. 14, 2013, Fujimori, et al.
U.S. Appl. No. 13/847,556, filed Mar. 20. 2013, Gotoh, et al.

* cited by examiner

LUBRICANT SUPPLYING DEVICE, AND IMAGE FORMING APPARATUS

CROSS-REFERENCE TO RELATED APPLICATIONS

The present application claims priority to and incorporates by reference the entire contents of Japanese Patent Application No. 2012-063099 filed in Japan on Mar. 21, 2012 and Japanese Patent Application No. 2012-153495 filed in Japan on Jul. 9, 2012.

BACKGROUND OF THE INVENTION

1. Field of the Invention

The present invention relates to a lubricant supplying device, and an image forming apparatus.

2. Description of the Related Art

Widely known are image forming apparatuses, such as printers, facsimiles, and copying machines, including a lubricant supplying device that supplies a lubricant to the surface of an image carrier to protect and reduce friction on the image carrier, such as a photosensitive element and an intermediate transfer belt serving as a target to be supplied with the lubricant.

The lubricant supplying device includes a supplying member that comes into contact with a bar-shaped solid lubricant and supplies a finely powdered lubricant scraped off by rubbing the solid lubricant to the image carrier. The lubricant supplying device further includes a lubricant holding member that holds a portion of the solid lubricant on the side opposite to the side coming into contact with the supplying member. The lubricant holding member is housed in a case of the lubricant supplying device in a manner movable in directions in which the solid lubricant comes into contact with and is separated from the supplying member. Furthermore, a pressing mechanism that presses a portion of the lubricant holding member on the side opposite to the solid lubricant holding side toward the supplying member is provided to a space on the side opposite to the solid lubricant holding side of the lubricant holding member in the case.

When the supplying member rotates, the solid lubricant in contact therewith is rubbed, and a lubricant scraped off from the solid lubricant and adhering to the supplying member is applied on the surface of the image carrier. As the solid lubricant is rubbed and gradually scraped by the supplying member, the lubricant holding member moves toward the supplying member. As a result, the solid lubricant is brought into contact with the supplying member from the early period to the last period, whereby the supplying member can scrape the solid lubricant reliably.

If an image forming operation is performed in a state where the lubricant runs out, no protective effect of the lubricant is exerted, thereby abrading and deteriorating the image carrier. Japanese Patent Application Laid-open No. 2010-271665 and Japanese Patent Application Laid-open No. 2011-197126 disclose lubricant supplying devices including a residual amount detecting unit. The residual amount detecting unit detects that there is only a small amount of a lubricant left by detecting that the length of a solid lubricant in a direction in which the solid lubricant moves while being scraped by the supplying member (hereinafter, referred to as the height of the solid lubricant) is equal to or smaller than a predetermined value.

The lubricant supplying devices disclosed in Japanese Patent Application Laid-open No. 2010-271665 and Japanese Patent Application Laid-open No. 2011-197126 include a lubricant holding member formed of a conductive member and an electrode member coming into contact with the conductive lubricant holding member. In the residual amount detecting unit disclosed in Japanese Patent Application Laid-open No. 2010-271665 and the sixth modification of Japanese Patent Application Laid-open No. 2011-197126, the conductive member and the lubricant holding member come into contact with each other to establish electrical continuity therebetween at the early period of use. If the height of the solid lubricant decreases and there is only a small amount of the lubricant left, the conductive member and the lubricant holding member are separated from each other to break the electrical continuity therebetween. Shifting from electrical continuity to electrical discontinuity in this manner enables the residual amount detecting unit to detect that there is only a small amount of the lubricant left.

By contrast, in the residual amount detecting unit disclosed in the fifth modification of Japanese Patent Application Laid-open No. 2011-197126, the conductive member and the lubricant holding member are separated from each other and do not establish electrical continuity therebetween at the early period of use. If the height of the solid lubricant decreases to equal to or smaller than the predetermined value, the conductive member and the lubricant holding member come into contact with each other to establish electrical continuity therebetween. Shifting from electrical discontinuity to electrical continuity in this manner enables the residual amount detecting unit to detect that there is only a small amount of the lubricant left.

In the residual amount detecting units disclosed in Japanese Patent Application Laid-open No. 2010-271665 and Japanese Patent Application Laid-open No. 2011-197126, an assembly error of the electrode member, for example, makes it difficult to detect a state just before the solid lubricant runs out (an end state). Therefore, the residual amount detecting units detect a state prior to the end state (a near-end state). As a result, the lubricant is not used up completely, and a part of the lubricant is wasted.

The present applicant is developing a lubricant supplying device including a lubricant end determining unit that measures the amount of lubricant applying operation, such as the number of sheets on which images are formed and the rotating distance (rotation rate) of the supplying member, after the residual detecting unit detects the near-end state and determines that the lubricant is in the end state when the amount of lubricant applying operation reaches a predetermined value. The lubricant supplying device can suppress waste of the lubricant.

The lubricant supplying device under development, however, has a defect in that the lubricant runs out before the amount of lubricant applying operation reaches the predetermined value. As a result of deliberate research on the defect, the present inventers found the following: the solid lubricant is readily scraped under a low-temperature environment and a low-humidity environment, and the solid lubricant decreases more quickly under the low-temperature environment and the low-humidity environment than under the normal environment.

In view of the problems described above, there is needed to provide a lubricant supplying device, and an image forming apparatus that can suppress waste of a lubricant and prevent operations of the device when the lubricant runs out.

SUMMARY OF THE INVENTION

It is an object of the present invention to at least partially solve the problems in the conventional technology.

According to the present invention, there is provided a lubricant supplying device comprising: a solid lubricant; a supplying member that comes into contact with the solid lubricant and supplies a lubricant scraped off by rubbing the solid lubricant to a target to be supplied with the lubricant; a residual amount detecting unit that detects that a residual amount of the solid lubricant is equal to or smaller than a predetermined amount by detecting that the length of the solid lubricant in a direction in which the solid lubricant moves while being scraped by the supplying member is equal to or smaller than a predetermined value; and a lubricant end determining unit that determines that the solid lubricant is in an end state when the amount of a lubricant supplying operation reaches a threshold after the residual amount detecting unit detects that the residual amount of the solid lubricant is equal to or smaller than the predetermined amount, wherein the lubricant end determining unit makes a threshold of the amount of the lubricant supplying operation at temperature or humidity of equal to or lower than a predetermined value lower than a threshold of the amount of the lubricant supplying operation at temperature or humidity of higher than the predetermined value.

The present invention also provides a lubricant supplying device comprising: a solid lubricant; a supplying member that comes into contact with the solid lubricant and supplies a lubricant scraped off by rubbing the solid lubricant to a target to be supplied with the lubricant; a residual amount detecting unit that detects that a residual amount of the solid lubricant is equal to or smaller than a predetermined amount by detecting that the length of the solid lubricant in a direction in which the solid lubricant moves while being scraped by the supplying member is equal to or smaller than a predetermined value; a lubricant end determining unit that determines that the solid lubricant is in an end state when the amount of a lubricant supplying operation reaches a threshold after the residual amount detecting unit detects that the residual amount of the solid lubricant is equal to or smaller than the predetermined amount; and a threshold setting unit that sets the threshold of the amount of the lubricant supplying operation based on consumption speed of the solid lubricant from an early period of use of the solid lubricant until the residual amount detecting unit detects that the residual amount of the solid lubricant is equal to or smaller than the predetermined amount.

The present invention also provides an image forming apparatus comprising: an image carrier; and a lubricant supplying unit that supplies a lubricant to a surface of the image carrier, the image forming apparatus transferring an image formed on the image carrier eventually onto a recording medium to form the image on the recording medium.

In the image forming apparatus mentioned above, the lubricant supplying device comprises; a solid lubricant, a supplying member that comes into contact with the solid lubricant and supplies a lubricant scraped off by rubbing the solid lubricant to a target to be supplied with the lubricant, a residual amount detecting unit that detects that a residual amount of the solid lubricant is equal to or smaller than a predetermined amount by detecting that the length of the solid lubricant in a direction in which the solid lubricant moves while being scraped by the supplying member is equal to or smaller than a predetermined value, and a lubricant end determining unit that determines that the solid lubricant is in an end state when the amount of a lubricant supplying operation reaches a threshold after the residual amount detecting unit detects that the residual amount of the solid lubricant is equal to or smaller than the predetermined amount, wherein the lubricant end determining unit makes a threshold of the amount of the lubricant supplying operation at temperature or humidity of equal to or lower than a predetermined value lower than a threshold of the amount of the lubricant supplying operation at temperature or humidity of higher than the predetermined value.

The present invention also provides an image forming apparatus comprising: an image carrier; and a lubricant supplying unit that supplies a lubricant to a surface of the image carrier, the image forming apparatus transferring an image formed on the image carrier eventually onto a recording medium to form the image on the recording medium.

In the image forming apparatus mentioned above, the lubricant supplying device comprises; a solid lubricant a supplying member that comes into contact with the solid lubricant and supplies a lubricant scraped off by rubbing the solid lubricant to a target to be supplied with the lubricant, a residual amount detecting unit that detects that a residual amount of the solid lubricant is equal to or smaller than a predetermined amount by detecting that the length of the solid lubricant in a direction in which the solid lubricant moves while being scraped by the supplying member is equal to or smaller than a predetermined value, a lubricant end determining unit that determines that the solid lubricant is in an end state when the amount of a lubricant supplying operation reaches a threshold after the residual amount detecting unit detects that the residual amount of the solid lubricant is equal to or smaller than the predetermined amount; and a threshold setting unit that sets the threshold of the amount of the lubricant supplying operation based on consumption speed of the solid lubricant from an early period of use of the solid lubricant until the residual amount detecting unit detects that the residual amount of the solid lubricant is equal to or smaller than the predetermined amount.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention applied to a printer serving as an electrophotography image forming apparatus are described below.

Figure 1:
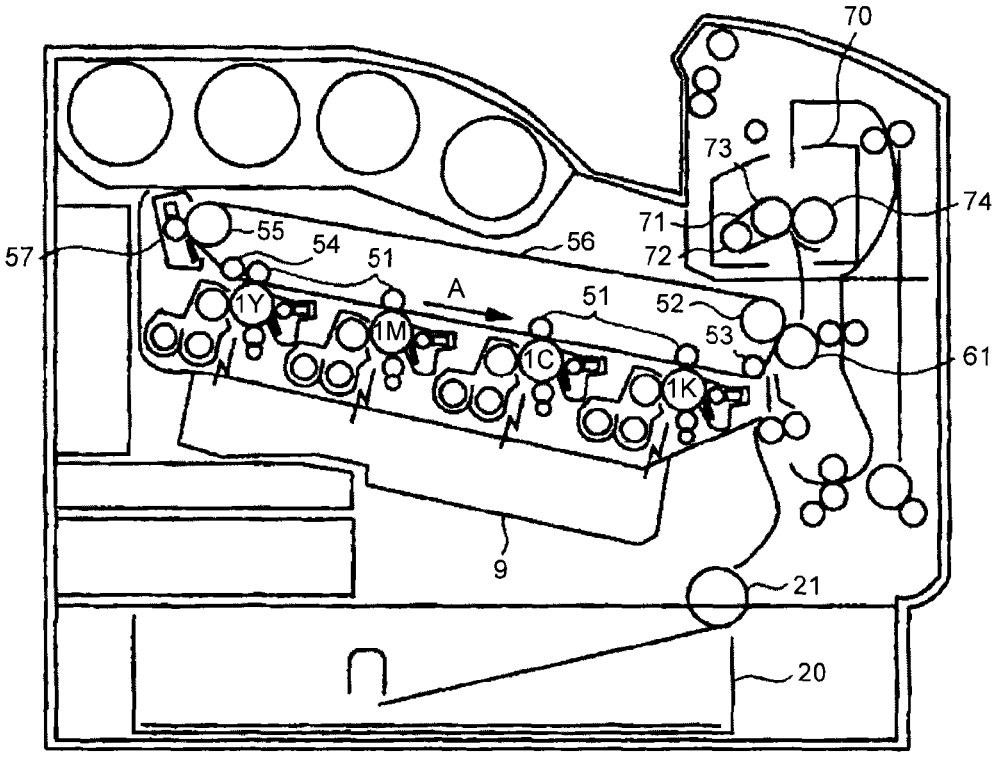
FIG. 1 is a schematic of a configuration of a printer according to a first embodiment of the present invention.

FIG. 1 is a schematic of a configuration of a printer according to an embodiment of the present invention. The printer includes an intermediate transfer belt 56 serving as an intermediate transfer body, which is an image carrier, nearly in the center thereof. The intermediate transfer belt 56 is made of a heat-resistant material, such as polyimide and polyamide, and is an endless belt formed of a base adjusted to medium resistance. The intermediate transfer belt 56 is stretched across and supported by four rollers 52, 53, 54, and 55 and is driven to rotate in a direction of an arrow A in FIG. 1. Four image forming units corresponding to toner in each color of yellow (Y), magenta (M), cyan (C), and black (K) are aligned below the intermediate transfer belt 56 along the belt surface of the intermediate transfer belt 56.

Figure 2:
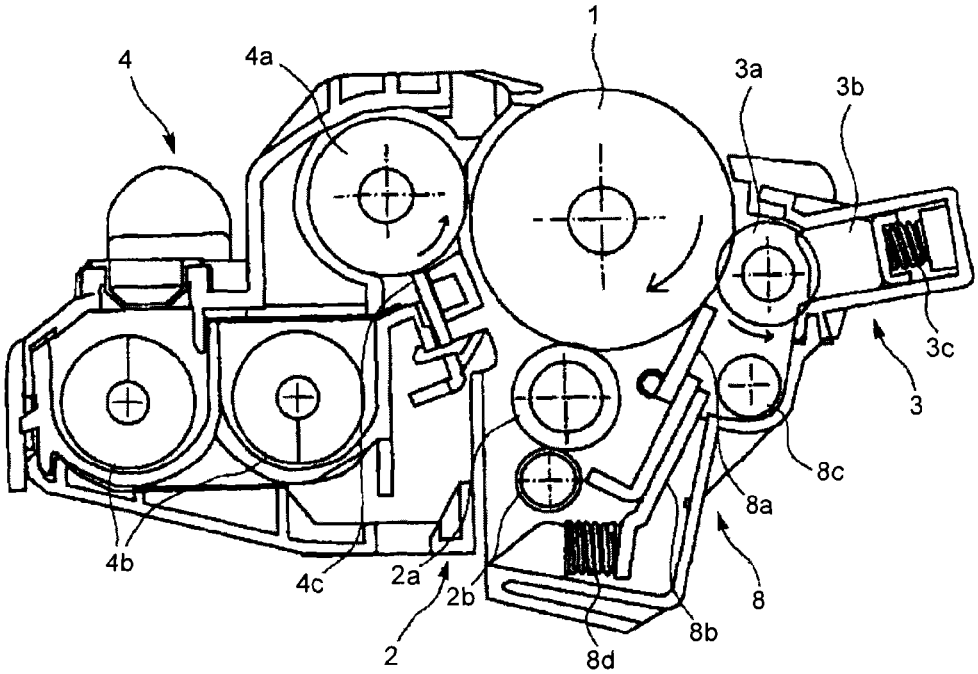
FIG. 2 is an enlarged view of one of four image forming units.

FIG. 2 is an enlarged view of one of the four image forming units. Because the image forming units have the same configuration, the reference characters Y, M, C, and K representing difference in color are omitted. The image forming unit includes a photosensitive element 1 serving as an image carrier, and a charging device 2, a developing device 4, a lubricant applying device 3, and a cleaning device 8 are arranged around the photosensitive element 1. The charging device 2, which is a charging unit, uniformly charges the surface of the photosensitive element to a desired electric potential (a negative polarity). The developing device 4, which is a developing unit, develops an electrostatic latent image formed on the surface of the photosensitive element into a toner image with toner in each color charged to a negative polarity. The lubricant applying device 3, which is a lubricant supplying device, supplies a lubricant to the surface of the photosensitive element by application. The cleaning device 8 cleans the surface of the photosensitive element after transfer of a toner image.

The image forming unit is formed as a process cartridge attachable to and detachable from the image forming apparatus. Thus, the photosensitive element 1, the charging device 2, the developing device 4, the cleaning device 8, and the lubricant applying device 3 are collectively replaced.

Referring back to FIG. 1, an exposing device 9 is provided below the four image forming units. The exposing device 9, which is an electrostatic latent image forming unit, exposes the surface of each charged photosensitive element based on image data of each color to lower the electric potential of the exposed portion and writes an electrostatic latent image to the surface of each photosensitive element. A primary transfer roller 51 is arranged at a position facing each photosensitive element 1 with the intermediate transfer belt 56 interposed therebetween. The primary transfer roller 51, a transfer unit, primarily transfers a toner image formed on the photosensitive element 1 onto the intermediate transfer belt 56. The primary transfer roller 51 is connected to a power supply, which is not illustrated, and a predetermined voltage is applied thereto.

A secondary transfer roller 61 serving as a secondary transfer unit is pressed against an external portion of the intermediate transfer belt 56 supported by the roller 52. The secondary transfer roller 61 is connected to the power supply, which is not illustrated, and a predetermined voltage is applied thereto. The portion at which the secondary transfer roller 61 and the intermediate transfer belt 56 come into contact with each other is a secondary transfer portion. A toner image on the intermediate transfer belt 56 is transferred onto a transfer sheet serving as a recording material at the secondary transfer portion. An intermediate transfer belt cleaning device 57 that cleans the surface of the intermediate transfer belt 56 after secondary transfer is provided to an external portion of the intermediate transfer belt 56 supported by the roller 55. A fixing device 70 that fixes a toner image formed on a transfer sheet to the transfer sheet is provided above the secondary transfer portion. The fixing device 70 includes a heating roller 72, an endless fixing belt 71, and a pressing roller 74. The heating roller 72 includes a halogen heater inside thereof. The fixing belt 71 is stretched around a fixing roller 73. The pressing roller 74 is arranged in a manner facing and pressed against the fixing roller 73 with the fixing belt 71 interposed therebetween. A feeding device 20 that houses transfer sheets and feeds the transfer sheets toward the secondary transfer portion is provided to the lower part of the printer.

The photosensitive element 1 is an organic photosensitive element and has a surface protective layer made of polycarbonate resin. The charging device 2 includes a roller charging device 2*a*, which is a charging member, obtained by coating a conductive cored bar with an elastic layer of medium resistance. The roller charging device 2*a* is connected to the power supply, which is not illustrated, and a predetermined voltage is applied thereto. The roller charging device 2*a* is provided in a manner facing the photosensitive element 1 with a minute gap interposed therebetween. The minute gap can be formed by: winding a spacer member having a constant thickness around an area in which no image is formed at both ends of the roller charging device 2*a*, and bringing the surface of the spacer member into contact with the surface of the photosensitive element 1, for example. The roller charging device 2*a* is provided with a charger cleaning member 2*b* that comes into contact with the surface of the roller charging device 2*a* to clean the surface.

The developing device 4 is provided with a developing sleeve 4*a*, which is a developer carrier, including a magnetic field generating unit inside thereof at a position facing the photosensitive element 1. Two screws 4*b* are arranged below the developing sleeve 4*a*. The two screws 4*b* mix toner supplied from a toner bottle, which is not illustrated, with a developer and lift the toner and the developer to the developing sleeve 4*a* while stirring them. The developer composed of the toner and magnetic carriers and lifted by the developing sleeve 4*a* is leveled to a predetermined thickness of a developer layer by a doctor blade 4*c* and is carried by the developing sleeve 4*a*. The developing sleeve 4*a* carries and conveys the developer while moving in the same direction as that of the photosensitive element 1 at a position facing the photosensitive element 1. Thus, the developing sleeve 4*a* supplies the toner to a portion of an electrostatic latent image formed on the photosensitive element 1. While FIG. 1 illustrates the configuration of the developing device 4 provided with a two-component developing structure, application of the present invention is not limited thereto. The present invention is also applicable to a developing device provided with a one-component developing structure.

The lubricant applying device 3 includes a solid lubricant 3*b* and an applying roller 3*a*. The solid lubricant 3*b* is housed in a fixed case. The applying roller 3*a*, which is a supplying member, constitutes an applying unit that applies a powdered lubricant scraped off from the solid lubricant 3*b* to the surface of the photosensitive element 1. A brush roller or a urethane foam roller may be used as the applying roller 3*a*. If a brush roller is used as the applying roller 3*a*, preferably used is a brush roller made of a material whose volume resistivity is adjusted within a range of equal to or larger than $1\times10^3$ Ω·cm and equal to or smaller than $1\times10^8$ Ωcm by adding a resistance control material, such as carbon black, to resin, such as nylon and acrylic. The applying roller 3*a* is dragged to rotate along the direction of rotation of the photosensitive element 1.

If a brush roller is used as the applying roller 3*a*, the lubricant consumption rate is extremely high at the early period of use of the solid lubricant. As the lubricant is consumed, the lubricant consumption rate gradually decreases, and the amount of consumption becomes stable at the middle period. For this reason, it is preferable that the applying roller 3*a* be driven to rotate and that the rotation rate of the applying roller 3*a* be gradually increased over time. With this configuration, a stable lubricant consumption rate can be achieved over time.

By contrast, if a urethane foam roller is used as the applying roller 3*a*, it is possible to reduce the lubricant consumption rate at the early period of use of the solid lubricant compared with a brush roller. Even if a urethane foam roller is used as the applying roller 3*a*, however, the lubricant consumption rate is high at the early period of use of the solid lubricant. For this reason, it is preferable that the rotation rate of the applying roller 3*a* be gradually increased over time.

The solid lubricant 3*b* is formed in a rectangular parallelepiped shape and is pressed against the applying roller 3*a* by a pressing mechanism 3*c*, which will be described later. A lubricant containing at least a fatty acid metal salt is used as the lubricant of the solid lubricant 3*b*. Examples of the fatty acid metal salt may include a fatty acid metal salt having a lamella crystal structure, such as fluororesin, zinc stearate, calcium stearate, barium stearate, aluminum stearate, and magnesium stearate; lauroyl lysine; monocetyl phosphate sodium zinc salt; and lauroyl taurine calcium. Zinc stearate is particularly preferably used among these fatty acid metal salts. This is because zinc stearate has excellent extensibility on the surface of the photosensitive element 1, low hygroscopicity, and lubricity unlikely to be deteriorated even if the humidity changes. Thus, it is possible to form a protective coating layer of the lubricant unlikely to be affected by environmental changes and having an excellent ability to protect the surface of the photosensitive element. As a result, the surface of the photosensitive element can be protected reliably. Furthermore, because of the lubricity unlikely to be deteriorated, cleaning failure can be reduced reliably. Besides these fatty acid metal salts, a liquid material, such as silicone oil, fluorine oil, and natural wax, and a gas material may be added by external addition.

The lubricant of the solid lubricant 3*b* preferably includes boron nitride, which is an inorganic lubricant. Examples of the crystal structure of boron nitride may include a low-pressure phase hexagonal crystal structure (h-BN) and a high-pressure phase cubic crystal structure (c-BN). Among the boron nitride having these structures, low-pressure phase hexagonal boron nitride has a layered structure and is readily cleaved. Therefore, low-pressure phase hexagonal boron nitride can maintain the coefficient of friction at approximately equal to or lower than 0.2 up to nearly 400 degrees C., and the property thereof is unlikely to be changed by an electric discharge. As a result, even if a lubricant containing low-pressure phase hexagonal boron nitride is subjected to an electric discharge, the lubricity thereof is less likely to be reduced than other lubricants. By adding such nitride boron, the lubricant supplied to the surface of the photosensitive element 1 as a thin film can be prevented from being deteriorated at an early stage by an electric discharge caused while the charging device 2 and the primary transfer roller 51 are operating. Boron nitride has a property unlikely to be changed by an electric discharge. As a result, even if a lubricant containing boron nitride is subjected to an electric discharge, the lubricity thereof is less likely to be reduced than other lubricants. In addition, the photosensitive layer of the photosensitive element 1 can be prevented from being oxidized and evaporated by the electric discharge. Furthermore, because boron nitride can exert its lubricity even in a small additive amount, boron nitride is effective against a defect caused by adhesion of the lubricant to the roller charging device 2*a* and blade squeal of the cleaning blade 8*a*.

A solid lubricant formed by compressing a lubricant material containing zinc stearate and boron nitride is used as the solid lubricant 3*b* according to the present embodiment. The forming method of the solid lubricant 3*b* is not limited thereto, and another forming method, such as a melt-forming method, may be used. Thus, the solid lubricant 3*b* can exert advantageous effects of zinc stearate and boron nitride described above.

The solid lubricant 3*b* is scraped and consumed by the applying roller 3*a*, and the thickness thereof decreases over time. Because the solid lubricant 3*b* is pressed by the pressing mechanism 3*c*, however, the solid lubricant 3*b* constantly comes into contact with the applying roller 3*a*. The applying roller 3*a* rotates to apply the lubricant thus scraped off to the surface of the photosensitive element. Subsequently, the cleaning blade 8*a* coming into contact with the surface of the photosensitive element 1 spreads the lubricant thus applied like a thin film. Thus, the coefficient of friction is lowered on the surface of the photosensitive element 1. Because the film of the lubricant adhering to the surface of the photosensitive element 1 is extremely thin, the film does not prevent the roller charging device 2*a* from charging the photosensitive element 1.

The cleaning device 8 includes the cleaning blade 8*a* serving as a cleaning member, a supporting member 8*b*, a toner collection coil 8*c*, and a blade pressing spring 8*d*. The cleaning blade 8*a* is formed of rubber, such as urethane rubber and silicone rubber, in a plate shape. The edge of the cleaning blade 8*a* comes into contact with the surface of the photosensitive element 1 to remove toner remaining on the photosensitive element 1 after transfer. The cleaning blade 8*a* is attached to and supported by the supporting member 8*b* made of a metal, plastic, and ceramic, and is arranged at a predetermined angle with respect to the surface of the photosensitive element 1. The cleaning blade 8*a* is brought into contact with the surface of the photosensitive element 1 by the blade pressing spring 8*d* at predetermined contact pressure and a predetermined thrust amount. Instead of the cleaning blade, any well-known cleaning member, such as a cleaning brush, may be used as the cleaning member.

In the present embodiment, the lubricant applying device 3 is arranged on the downstream of a position at which the photosensitive element 1 faces the primary transfer roller 51 (a primary transfer portion) and on the upstream of the cleaning device 8 in a movement direction of the surface of the photosensitive element. With this configuration, the lubricant applied to the surface of the photosensitive element by the lubricant applying device 3 can be spread out by the cleaning blade 8*a* rubbing the surface of the photosensitive element. Thus, it is possible to roughly eliminate unevenness of the lubricant applied to the surface of the photosensitive element. Alternatively, the lubricant applying device 3 may be arranged on the downstream of a position at which the photosensitive element 1 faces the cleaning device 8 (a cleaning position) and on the upstream of a position at which the photosensitive element 1 faces the charging device 2 (a charging position) in the movement direction of the surface of the photosensitive element. In this case, if the image forming unit is provided with a neutralization unit that neutralizes the surface of the photosensitive element before charging performed by the charging device 2, the lubricant applying device 3 is arranged on the upstream of a position at which the photosensitive element 1 faces the neutralization unit (a neutralization position).

In the present embodiment, the lubricant applying device 3 is provided to the inside of the cleaning device 8. With this configuration, toner that adheres to the applying roller 3*a* when the applying roller 3*a* rubs the photosensitive element 1 can be flicked by the solid lubricant 3*b* or a flicker, which is not illustrated. As a result, the toner can be readily collected by the toner collection coil 8*c* together with the toner collected by the cleaning blade 8*a*.

The lubricant applying device 3 will now be described in greater detail.

Figure 3:
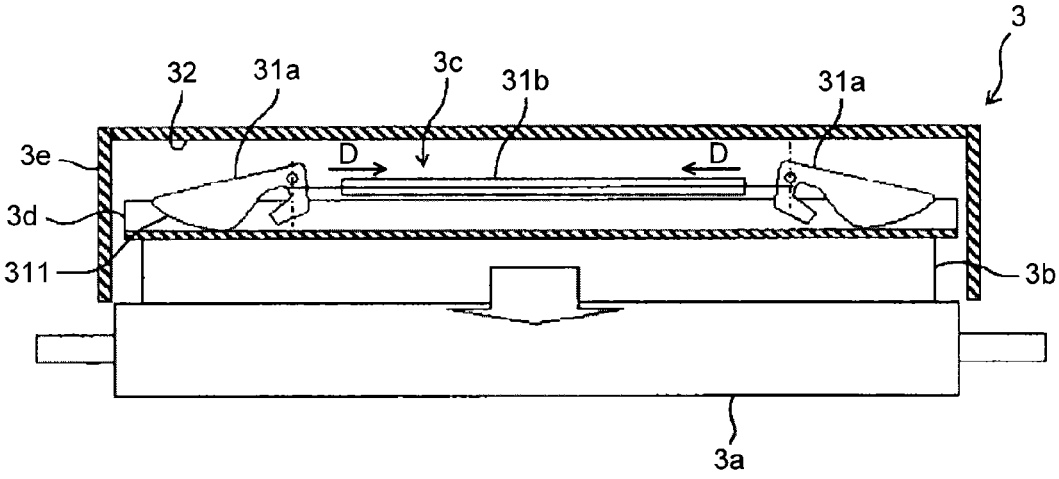
FIG. 3 is a schematic of a configuration of a lubricant applying device.

FIG. 3 is a schematic of a configuration of the lubricant applying device 3.

As illustrated in FIG. 3, the lubricant applying device 3 includes a lubricant holding member 3*d* that holds a portion of the solid lubricant 3*b* on the side opposite to the surface coming into contact with the applying roller 3*a* (surface on the lower side in FIG. 3) over the longitudinal direction. The lubricant holding member 3*d* is provided in a storage case 3*e* in a manner capable of being brought into contact with and separated from the applying roller 3*a*. The lubricant applying device 3 further includes the pressing mechanism 3*c* that presses the lubricant holding member 3*d* toward the supplying member in a space on the upper side with respect to the lubricant holding member 3*d* in the storage case 3*e* in FIG. 3.

The pressing mechanism 3*c* includes swinging members 31*a* and a spring 31*b* serving as a biasing unit. The swinging members 31*a* are provided near the ends in the longitudinal direction of the lubricant holding member 3*d* and are attached to the storage case 3*e* in a swingable manner. The ends of the spring 31*b* are each attached to the swinging member 31*a*. Each of the swinging members 31*a* is subjected to biasing force of the spring 31*b* in a direction of an arrow D in FIG. 3 toward the center in the longitudinal direction of the lubricant holding member. The biasing force biases the swinging member on the right side in FIG. 3 so as to swing in an anticlockwise direction in FIG. 3 and the swinging member on the left side in FIG. 3 so as to swing in a clockwise direction in FIG. 3. As a result, an arc-shaped contact portion 311 of each of the swinging members 31*a* coming into contact with the lubricant holding member 3*d* is biased toward the lubricant holding member 3*d* as illustrated in FIG. 3.

At the early period of use, a swinging end of each of the swinging members 31*a* is positioned closer to an inner periphery 32 of the upper surface of the storage case 3*e* while resisting the biasing force of the spring 31*b*. With this configuration, the two swinging members 31*a* are subjected to the biasing force of the spring 31*b* to press the lubricant holding member 3*d* with equal force, thereby pressing the solid lubricant 3*b* held by the lubricant holding member 3*d* against the applying roller 3*a*. Thus, the solid lubricant 3*b* is pressed against the applying roller 3*a* uniformly in the longitudinal direction. As a result, the amount of the lubricant scraped off by the applying roller 3*a* rotating to rub the solid lubricant 3*b* is uniform in the longitudinal direction. Therefore, it is possible to apply the lubricant evenly on the surface of the photosensitive element 1.

Figure 4:
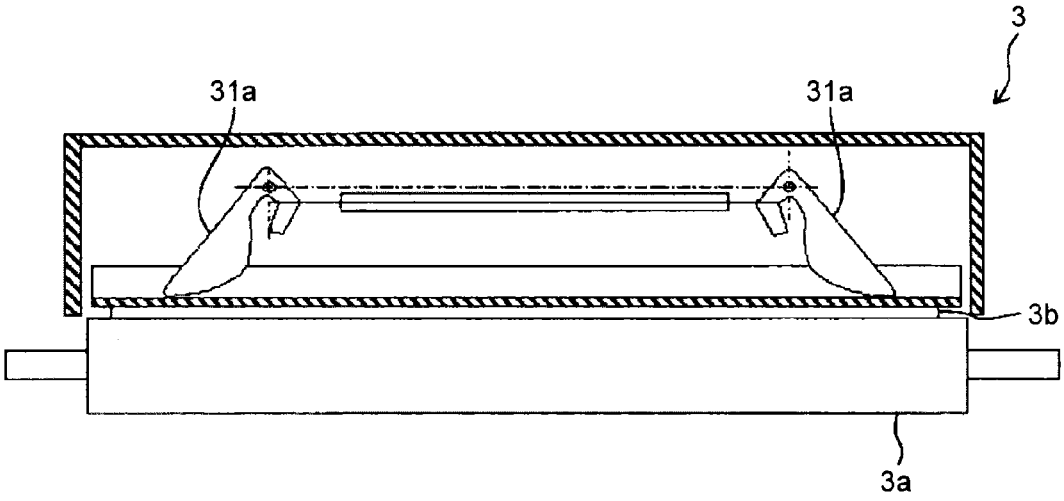
FIG. 4 is a schematic of the configuration of the lubricant applying device at the last period of use.

FIG. 4 is a schematic of the configuration of the lubricant applying device 3 at the last period of use (when there is only a small amount of the solid lubricant left).

If the solid lubricant 3*b* is rubbed and gradually scraped by the applying roller 3*a*, the swinging members 31*a* swing to cause the lubricant holding member 3*d* to move toward the applying roller. If there is only a small amount of the solid lubricant left eventually as illustrated in FIG. 4, the swinging ends of the swinging members 31*a* come into contact with the lubricant holding member 3*d*.

The pressing mechanism 3*c* according to the present embodiment can prevent reduction in pressing force applied to the solid lubricant 3*b* even if the height of the solid lubricant 3*b* decreases in use over time. Therefore, it is possible to reduce fluctuations in the amount of the powder lubricant supplied to the surface of the photosensitive element 1 from the early period over time.

The reason for this result is as follows.

Typically, in terms of the amount of change in extension of a spring changing from the early period until the solid lubricant 3*b* runs out, fluctuations in biasing force of the spring to the amount of change in extension of the spring can be reduced as the total length of the spring is increased. In a conventional pressing mechanism, a spring is arranged in a compressed state, and a direction of the biasing force (thrusting force) coincides with a direction for pressing the solid lubricant 3*b* against the applying roller 3*a*. In this configuration, as the total length of the spring is increased, it becomes difficult to cause the direction of the biasing force of the spring to coincide with the direction for pressing the solid lubricant 3*b* against the applying roller 3*a*. Thus, there is a limit to the increase in the total length of the spring. In addition, the conventional pressing mechanism needs to secure an arrangement space for the length of the spring in a radial direction of the applying roller 3*a*, resulting in an increase in size of the device. For these reasons, the conventional pressing mechanism needs to use a relatively short spring, whereby fluctuations in the biasing force of the spring are made larger over time.

By contrast, the pressing mechanism 3*c* according to the present embodiment is provided with the spring 31*b* in an extended state as illustrated in FIG. 3 and can press the solid lubricant 3*b* against the applying roller 3*a* with the biasing force (pulling force). Therefore, even if the total length of the spring is increased, the pressing mechanism 3*c* does not suffer such problems occurring in the conventional pressing mechanism. In addition, in the pressing mechanism 3*c* according to the present embodiment, the spring 31*b* is arranged such that the length direction of the spring 31*b* coincides with the longitudinal direction of the solid lubricant 3*b*, that is, the axial direction of the applying roller 3*a*. Therefore, even if the length of the spring 31*b* is increased, it is not necessary to expand the arrangement space in the radial direction of the applying roller 3*a* and to increase the size of the device. For these reasons, the pressing mechanism 3*c* according to the present embodiment can use the spring 31*b* that is significantly longer than the spring used in the conventional pressing mechanism. As a result, fluctuations in biasing force of the spring can be reduced over time.

If the solid lubricant 3*b* formed by compressing a powder lubricant is used, the lubricant consumption rate is high at the early period. In the solid lubricant 3*b* formed by compressing a powder lubricant, the powder lubricant may possibly be exfoliated from the solid lubricant as a fine lump at the start of scraping by the applying roller 3*a* rubbing the solid lubricant 3*b*. Thus, a larger amount of the lubricant than a desired amount of the scraped lubricant is scraped off. As a result, the lubricant consumption rate is made high at the early period. Because the exfoliation phenomenon in which the powder lubricant is exfoliated from the solid lubricant as a fine lump hardly occurs at the middle period, it is possible to stably achieve a desired amount of the scraped lubricant at the middle period.

For this reason, in the present embodiment, the pressing force applied to the solid lubricant at the early period is set smaller than that at the middle period.

Figure 5:
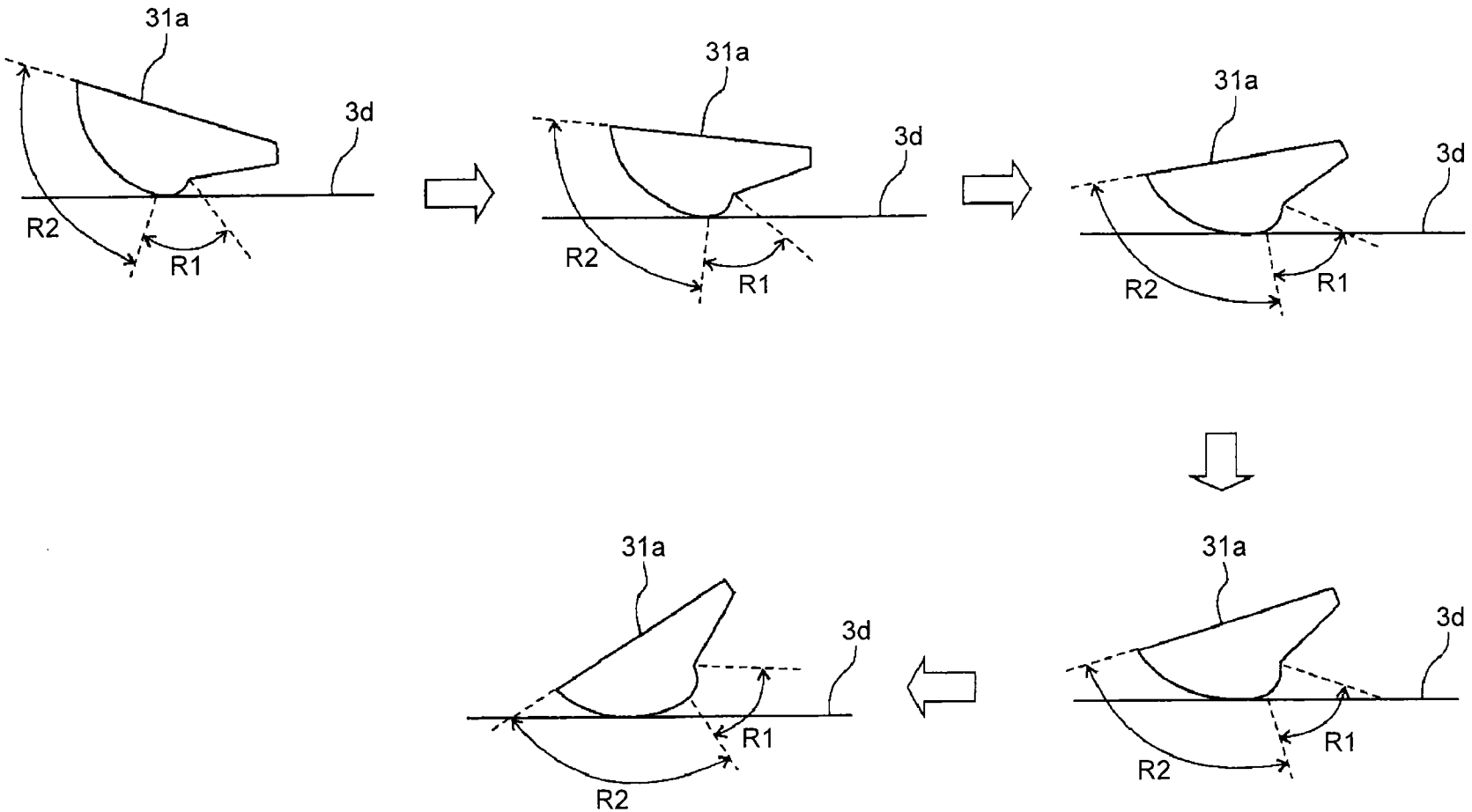
FIG. 5 is a view for explaining postural change from the early period to the last period of a swinging member configured such that pressing force against a solid lubricant at the early period is smaller than that at the middle period.

FIG. 5 is a view for explaining postural change from the early period to the last period of the swinging member 31*a* configured such that the pressing force against the solid lubricant at the early period is smaller than that at the middle period. The contact portion 311 of the swinging member 31*a* comes into contact with the lubricant holding member 3*d* during the early period when the amount of the scraped lubricant is excessive temporarily, the meddle period when the amount of the scraped lubricant becomes stable, and the last period when the solid lubricant 3*b* is scraped by equal to or more than a predetermined amount and there is only a small amount of the solid lubricant 3*b* left. The contact portion 311 is designed such that curvature R1 of a contact part of the swinging member 31*a* that comes into contact with the lubricant holding member 3*d* at the early period is different from curvature R2 of a contact part of the swinging member 31*a* that comes into contact with the lubricant holding member 3*d* at the middle period. Specifically, the curved shape of the contact portion 311 of the swinging member 31*a* is set such that the curvature R1 for the early period is larger than the curvature R2 for the middle period. With this configuration, the pressing force against the solid lubricant at the early period is smaller than that at the middle period.

Figure 6:
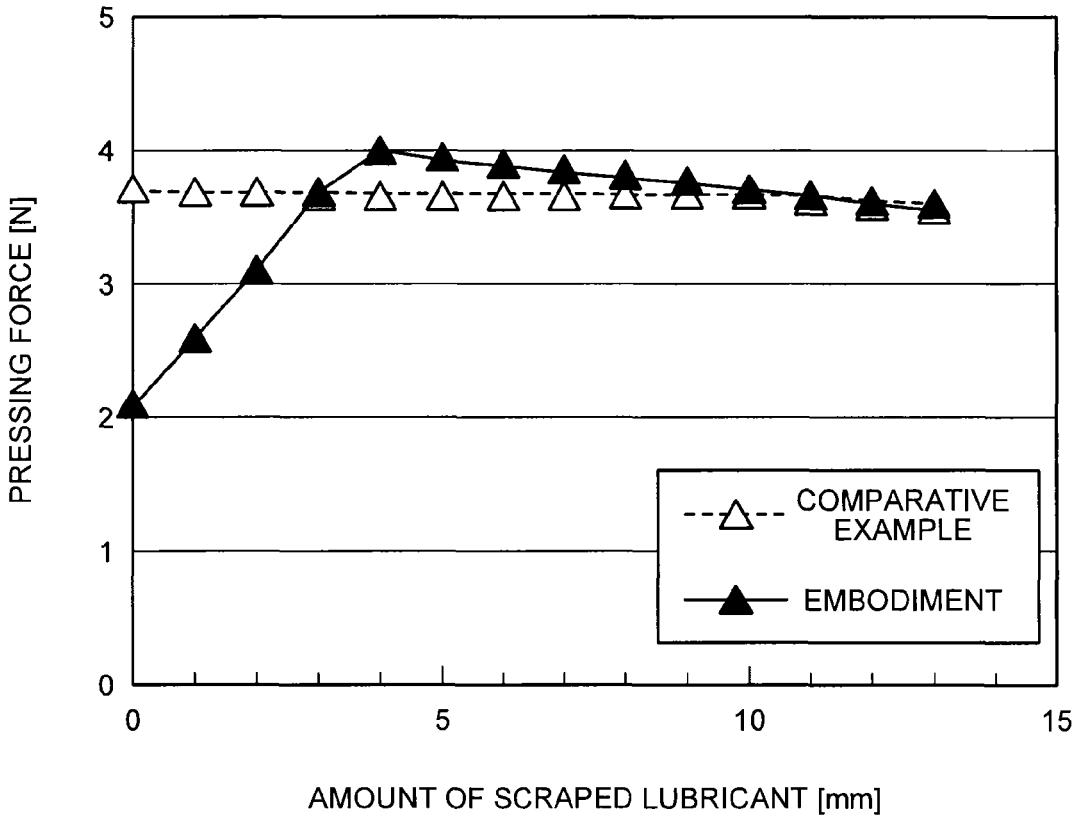
FIG. 6 is a graph of temporal change of the pressing force against the solid lubricant generated by a pressing mechanism.

FIG. 6 is a graph of temporal change of the pressing force against the solid lubricant 3*b* generated by the pressing mechanism 3*c*.

As indicated by a solid line in FIG. 6, if the swinging member 31*a* according to the present embodiment is used, an early-period contact portion of the swinging member 31*a* having the larger curvature R1 comes into contact with the lubricant holding member 3*d* at the early period as illustrated in FIG. 5. As the solid lubricant 3*b* is rubbed and scraped by the applying roller 3*a* and the accumulated amount of the scraped lubricant increases, the swinging member 31*a* rotates about the attachment position. As a result, the contact part of the swinging member 31*a* coming into contact with the lubricant holding member 3*d* gradually shifts to a middle-period contact portion having the smaller curvature R2. Thus, the pressing force gradually increases during the early period from small pressing force at the start of the early period and reaches pressing force required for achieving the amount of the scraped lubricant appropriate for the middle period at the start of the middle period.

In other words, in the present embodiment, the curved shape of the contact portion 311 of the swinging member 31*a* is adjusted so as to realize the following pressing force profile: pressing force N is low at the start of the early period; the pressing force N increases until the amount of the scraped lubricant reaches a certain amount (until just before the middle period starts); and the pressing force N becomes constant when the amount of the scraped lubricant reaches the certain amount (when the middle period starts).

By changing the curvature of the curved shape constituting the contact portion 311 of the swinging member 31*a*, the position at which the parts having different curvature are in contact with each other, and the position of the point to which the force for pressing the lubricant holding member 3*d* is applied, for example, it is possible to adjust the increase rate of the pressing force at the early period and the timing at which the pressing force is made constant.

In a comparative example indicated by a dotted line in FIG. 6, the curvature of the contact portion 311 of the swinging member 31*a* that comes into contact with the lubricant holding member 3*d* is set such that the pressing force is constant from the early period to the last period.

As described above, the pressing force against the solid lubricant at the early period is made smaller than that at the middle period. As a result, the lubricant consumption rate at the early period can be reduced, whereby reduction in life of the solid lubricant 3*b* can be prevented.

Figure 7:
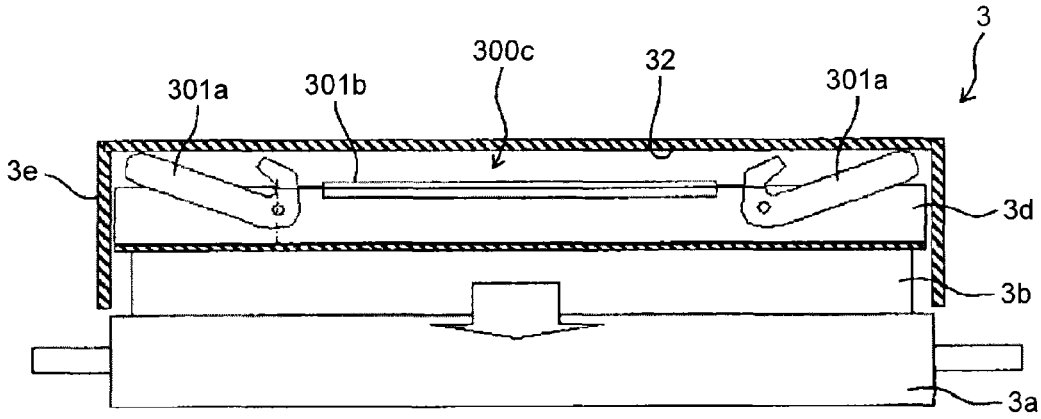
FIG. 7 is a schematic of a configuration of the lubricant applying device including a pressing mechanism according to a modification.

FIG. 7 is a schematic of a configuration of the lubricant applying device including a pressing mechanism according to a modification.

In a pressing mechanism 300*c* according to the modification, swinging members 301*a* are attached to the lubricant holding member 3*d* in a swingable manner. As a result, biasing force of a spring 301*b* toward the center in the longitudinal direction of the lubricant holding member 3*d* biases a swinging end of each of the swinging members 301*a* in a direction away from the lubricant holding member 3*d*. Thus, the swinging end of each of the swinging members 301*a* comes into contact with the inner periphery 32 of the upper surface of the storage case 3*e*.

As illustrated in FIG. 7, the swinging end of each of the swinging members 301*a* is positioned closer to the lubricant holding member 3*d* while resisting the biasing force of the spring 301*b* at the early period of use. In the modification, the two swinging members 301*a* are subjected to the biasing force of the spring 301*b* to press the inner periphery 32 of the upper surface of the case with equal force, thereby pressing the solid lubricant 3*b* held by the lubricant holding member 3*d* against the applying roller 3*a*. In the present modification as well, if the solid lubricant 3*b* is rubbed and gradually scraped by the applying roller 3*a*, the swinging members 301*a* swing to cause the lubricant holding member 3*d* to move toward the applying roller. If there is only a small amount of the solid lubricant left eventually, the swinging members 301*a* swing to a state illustrated in FIG. 8.

An explanation will be made of a residual amount detecting mechanism 40 serving as a residual amount detecting unit that detects a near-end state of the solid lubricant according to the present embodiment.

Figure 9:
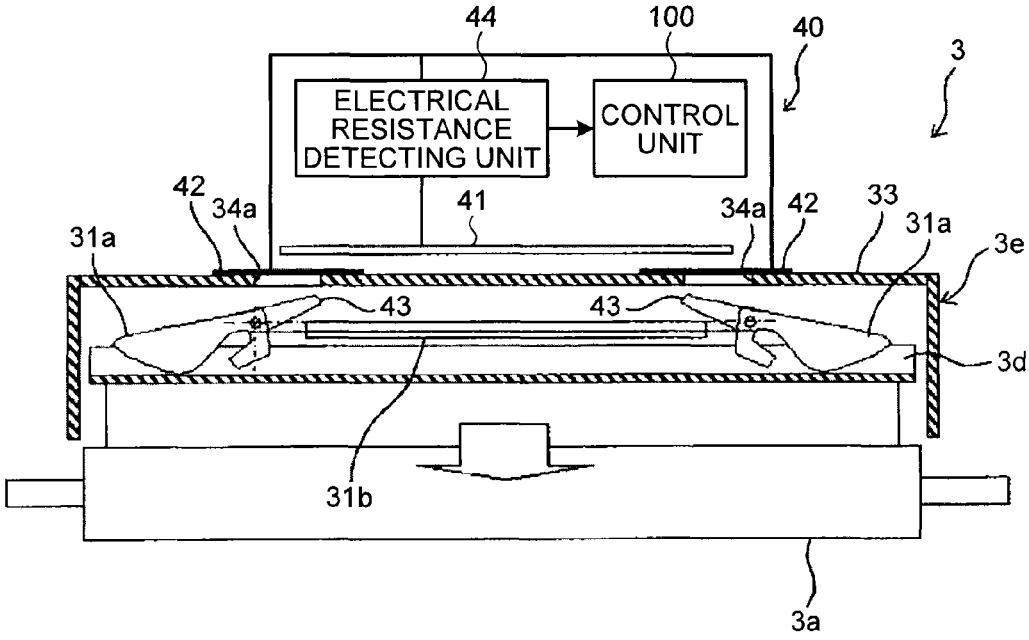
FIG. 9 is a schematic of a configuration of the lubricant applying device including a residual amount detecting mechanism.

FIG. 9 is a schematic of a configuration of the lubricant applying device 3 including the pressing mechanism 3*c* illustrated in FIG. 3 and FIG. 4 further provided with the residual amount detecting mechanism 40 according to the present embodiment.

As illustrated in FIG. 9, the residual amount detecting mechanism 40 includes a second electrode member 41, a first electrode member 42, and a pressing member 43 serving as an electrode pressing unit. The second electrode member 41 is arranged in a manner facing an outer periphery 33 of the upper surface of the storage case 3*e* with a predetermined gap interposed therebetween. Openings 34*a* are formed near the ends in the longitudinal direction of the upper surface of the storage case 3*e*, and the elastically deformable first electrode members 42 are provided so as to cover the openings 34*a*. The pressing member 43 is attached to each of the swinging members 31*a* in a manner protruding from the end on the swinging fulcrum side of each of the swinging members 31*a*. One end of the first electrode member 42 is fixed to the outer periphery 33 of the upper surface of the storage case 3*e* with an adhesive, for example.

The second electrode member 41 and each of the first electrode members 42 are connected to an electrical resistance detecting unit 44 serving as a voltage applying unit. The electrical resistance detecting unit 44 is connected to a control unit 100 that controls the electrical resistance detecting unit 44. The electrical resistance detecting unit 44 applies voltage between the second electrode member 41 and the first electrode member 42 to measure electrical resistance.

As illustrated in FIG. 9, the pressing member 43 attached to each of the swinging members 31*a* is separated from the first electrode member 42 at the early period of use. At this time, the second electrode member 41 and each of the first electrode members 42 are separated from each other and do not establish electrical continuity therebetween. Therefore, even if the electrical resistance detecting unit 44 applies voltage between the second electrode member 41 and the first electrode member 42 at this time, no electric current flows between the second electrode member 41 and the first electrode member 42. As a result, measurement of the electrical resistance value fails to be made.

Figure 10:
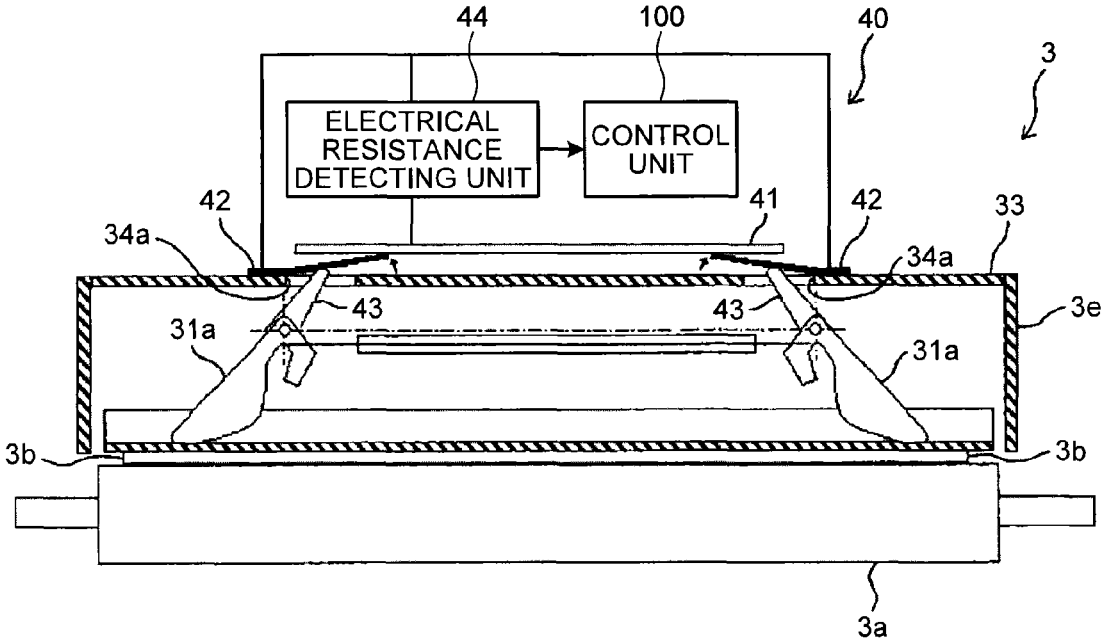
FIG. 10 is a view of a state where the solid lubricant is in a near-end state.

As the solid lubricant 3*b* is scraped, the lubricant is consumed, and the swinging member 31*a* swings, the tip of the pressing member 43 gradually moves closer to the first electrode member 42 and eventually comes into contact with the first electrode member 42. If the lubricant is further consumed and the swinging member 31*a* further swings, the pressing member 43 presses the elastically deformable first electrode member 42 toward the second electrode member 41. If the pressing member 43 presses the first electrode member 42 toward the second electrode member 41, the other end of the first electrode member 42 not being fixed to the outer periphery 33 of the upper surface of the storage case 3*e* is separated from the outer periphery 33 of the upper surface of the storage case 3*e*. If there is only a small amount of the solid lubricant 3*b* left (the near-end state) as illustrated in FIG. 10, the first electrode member 42 comes into contact with the second electrode member 41. If the first electrode member 42 comes into contact with the second electrode member 41, the state between the second electrode member 41 and the first electrode member 42 shifts from electrical discontinuity to electrical continuity. As a result, if the electrical resistance detecting unit 44 applies voltage between the second electrode member 41 and the first electrode member 42, an electric current flows between the second electrode member 41 and the first electrode member 42. Thus, the electrical resistance detecting unit 44 measures the electrical resistance value.

The control unit 100 monitors the results of measurement made by the electrical resistance detecting unit 44. If the control unit 100 detects that the electrical resistance value detected by the electrical resistance detecting unit 44 is equal to or smaller than a predetermined value, the control unit 100 determines that the lubricant is in the near-end state. The control unit 100 then notifies an operation display unit, which is not illustrated, of the fact that there is only a small amount of the lubricant left and prompts a user to replace the solid lubricant. Alternatively, the control unit 100 may notify a service center of the fact that the lubricant needs to be replaced using a communication unit, which is not illustrated.

In the residual amount detecting mechanism 40 according to the present embodiment, the second electrode member 41 is provided to the outside of the storage case 3*e*, and the second electrode member 41 and the first electrode member 42 are electrically connected outside the storage case 3*e*. With this configuration, it is possible to prevent adhesion of the lubricant to a portion of the second electrode member 41 coming into contact with the first electrode member 42 and to a portion of the first electrode member 42 coming into contact with the second electrode member 41 compared with a residual amount detecting mechanism in which the second electrode member 41 and the first electrode member 42 are electrically connected inside the storage case 3*e*. As a result, it is possible to prevent poor electrical continuity between the second electrode member 41 and the first electrode member 42 because of adhesion of the lubricant to the contact portion when the lubricant is in the near-end state.

In the present embodiment, the first electrode member 42 covers the opening 34*a* until the pressing member 43 presses the first electrode member 42 toward the second electrode member 41. With this configuration, it is possible to prevent scattering of the lubricant in the storage case 3*e* through the opening 34*a*. As a result, it is possible to further prevent adhesion of the lubricant to the portion of the second electrode member 41 coming into contact with the first electrode member 42 and to the portion of the first electrode member 42 coming into contact with the second electrode member 41.

In the present embodiment, the second electrode member 41 and the first electrode member 42 are in electrical discontinuity before the amount of the lubricant becomes near-end. Therefore, even if voltage is applied between the electrode members, no electric current flows therebetween. As a result, it is possible to prevent electric power from being consumed every time detection of the near-end state is performed, thereby reducing power consumption.

In the present embodiment, the first electrode members 42 are provided near the left and the right ends in FIG. 9 (near both the ends in the longitudinal direction of the solid lubricant 3*b*). Therefore, even if the amounts of the consumed lubricant vary in the longitudinal direction of the solid lubricant 3*b*, the first electrode member 42 on the end consuming a larger amount of the lubricant comes into contact with the second electrode member 41 and establishes electrical continuity therewith when the end consuming a larger amount of the lubricant reaches the near-end state. With this configuration, even if the amounts of the consumed lubricant vary in the longitudinal direction of the solid lubricant 3*b*, the near-end state of the lubricant can be detected accurately. Thus, it is possible to prevent a defect in that the lubricant on the end consuming a larger amount of the lubricant runs out and the surface of the photosensitive element is damaged without being protected by the lubricant, for example.

While the first electrode members 42 are provided to the respective openings 34*a* to cover the respective openings 34*a* in the present embodiment, a single first electrode member 42 may cover the openings 34*a*. Furthermore, while the first electrode member 42 is formed of an elastically deformable member in the present embodiment, a first end of the first electrode member 42 may be attached to the storage case 3*e* in a rotatable manner. In this configuration, if the pressing member 43 presses the first electrode member 42, the first electrode member 42 swings while being supported by the first end, whereby the first electrode member 42 comes into contact with the second electrode member 41.

Figure 11:
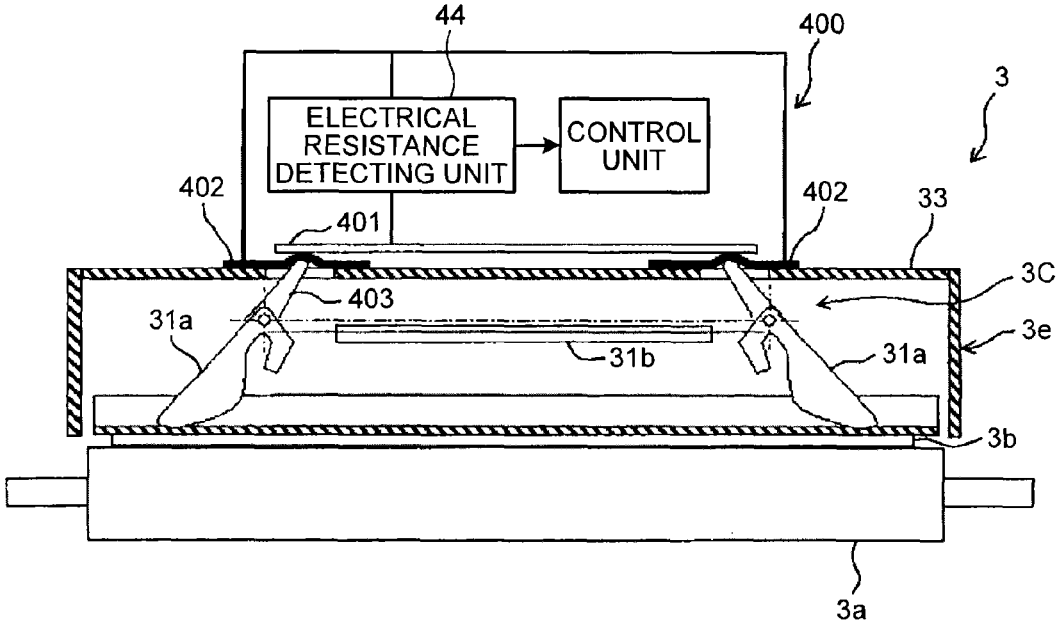
FIG. 11 is a schematic of a first modification of the residual amount detecting mechanism.

FIG. 11 is a schematic of a configuration of a residual amount detecting mechanism 400 according to a first modification.

As illustrated in FIG. 11, the residual amount detecting mechanism 400 according to the present modification has a first electrode member 402 formed of an elastic member, such as a conductive rubber. The first electrode member 402 is fixed to the outer periphery 33 of the upper surface of the storage case in a manner incapable of being separated therefrom. Thus, the first electrode member 402 completely covers the opening 34*a*.

In this case, if the solid lubricant 3*b* comes in the near-end state and the tip of a pressing member 403 presses the first electrode member 402 as illustrated in FIG. 11, a contact portion of the first electrode member 402 formed of a flexible member with the pressing member 403 comes into contact with a second electrode member 401 in a manner protruding toward the second electrode member 401. Thus, the state between the electrode members shifts from electrical discontinuity to electrical continuity, whereby the near-end state of the lubricant can be detected in the present modification as well.

Because the first electrode member 402 completely covers the opening 34*a* in the first modification, the lubricant can be completely prevented from scattering through the opening 34*a*. As a result, it is possible to further prevent adhesion of the lubricant to a portion of the second electrode member 401 coming into contact with the first electrode member 402 and to a portion of the first electrode member 402 coming into contact with the second electrode member 401.

Figure 8:
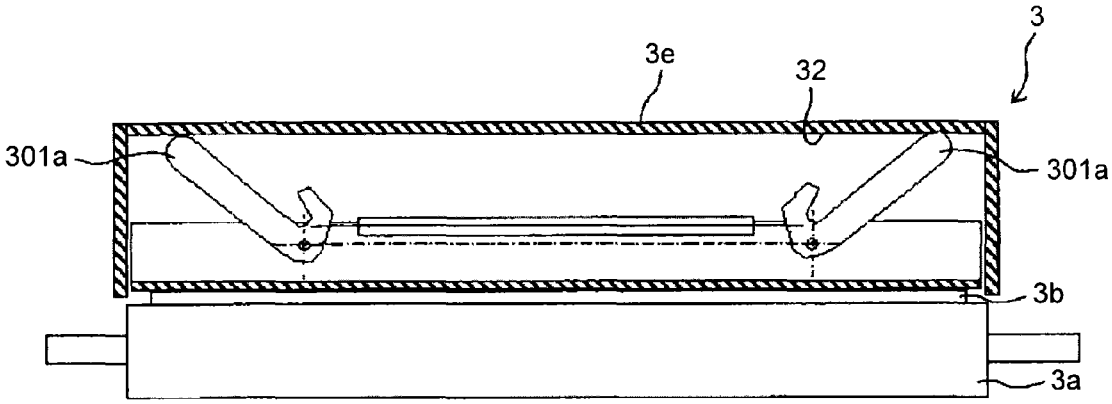
FIG. 8 is a schematic of the configuration of the lubricant applying device illustrated in FIG. 7 at the last period of use.
Figure 12:
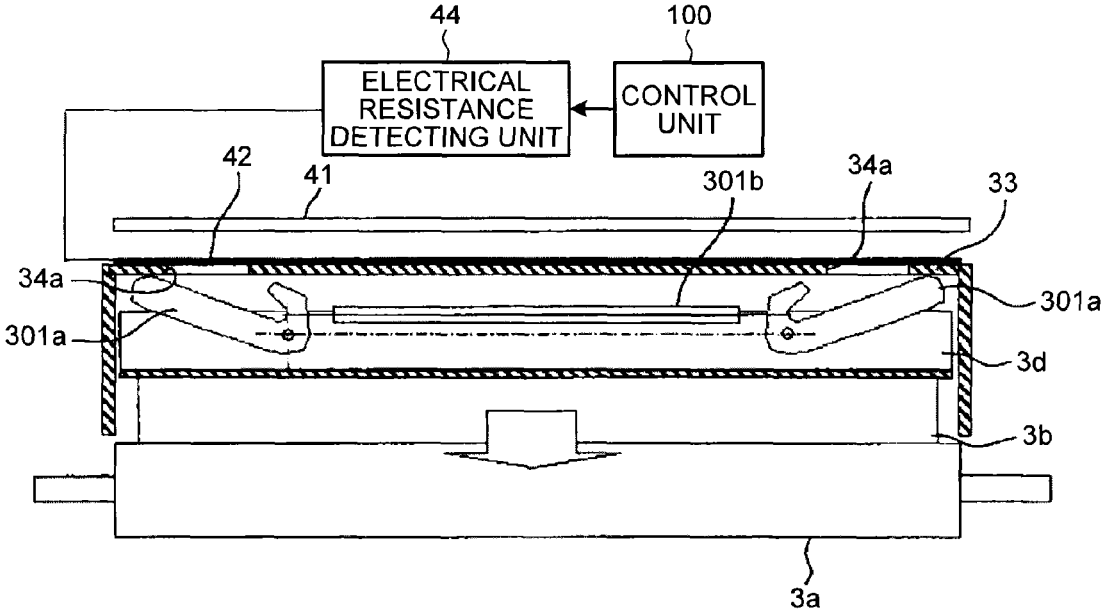
FIG. 12 is a view of an aspect in which the residual amount detecting mechanism is applied to the lubricant applying device including the pressing mechanism according to the modification.

FIG. 12 is a schematic of a configuration of the lubricant applying device 3 including the pressing mechanism 3*c* illustrated in FIG. 7 and FIG. 8 further provided with the residual amount detecting mechanism 40 according to the present embodiment.

In the residual amount detecting mechanism 40 illustrated in FIG. 12, a single first electrode member 42 covers the openings 34*a*. Furthermore, in the residual amount detecting mechanism 40 illustrated in FIG. 12, the swinging member 301*a* functions as a pressing member that presses the first electrode member 42 toward the second electrode member 41. The opening 34*a* is formed at a position where a swinging tip of the swinging member 301*a* reaches when the solid lubricant 3*b* comes in the near-end state.

Figure 13:
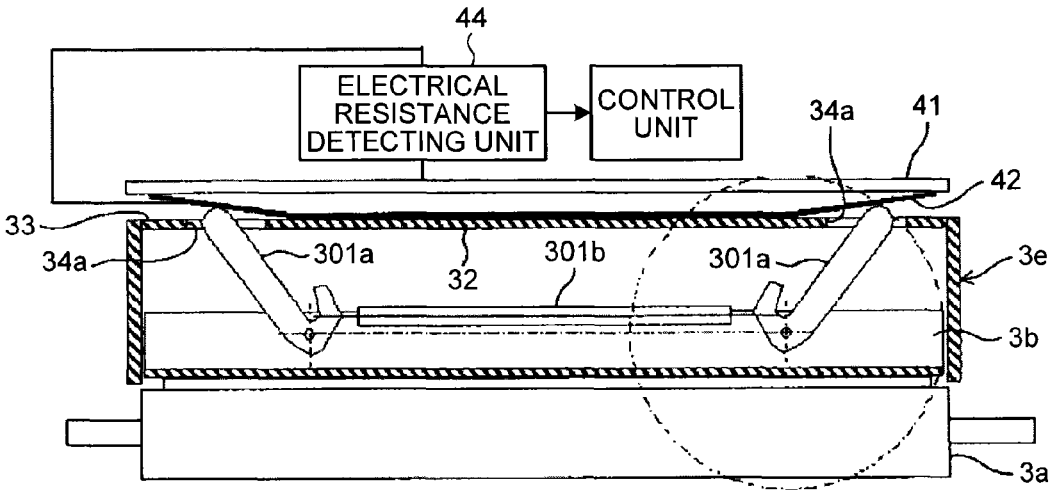
FIG. 13 is a view of a state where the solid lubricant is in the near-end state in the aspect illustrated in FIG. 12.

In the configuration illustrated in FIG. 12, as the solid lubricant 3*b* is scraped, the lubricant is consumed, and the swinging member 301*a* swings, the swinging tip of the swinging member 301*a* swings on the inner periphery 32 of the upper surface of the storage case and moves closer to the opening 34*a*. If the lubricant is further consumed and there is only a small amount of the solid lubricant 3*b* left (the near-end state) as illustrated in FIG. 13, the swinging tip of the swinging member 301*a* reaches the opening 34*a* and comes into contact with the first electrode member 42. If the swinging member 301*a* comes into contact with the first electrode member 42, the biasing force of the spring 301*b* presses the first electrode member 42 toward the second electrode member 41, thereby bringing the first electrode member 42 into contact with the second electrode member 41. Thus, the state between the electrode members shifts from electrical discontinuity to electrical continuity, whereby the near-end state of the lubricant is detected.

In the configuration illustrated in FIG. 12 as well, the first electrode member 42 covers the opening 34*a* until the lubricant comes in the near-end state. As a result, it is possible to prevent scattering of the lubricant through the opening 34*a* and poor electrical continuity because of adhesion of the lubricant.

Accurate detection of a state just before the solid lubricant runs out (an end state) by the residual amount detecting mechanism 40 is difficult to achieve because of an assembly error of the second electrode member 41 (a gap error between the first electrode member 42 and the second electrode member 41), for example. For this reason, the residual amount detecting mechanism 40 detects the near-end state of the lubricant. Even after the residual amount detecting mechanism 40 detects the near-end state, however, if an image forming operation is performed for a predetermined number of times, the lubricant can be applied to the surface of the photosensitive element reliably to protect the surface of the photosensitive element. Therefore, if the image forming operation is prohibited after the residual amount detecting mechanism 40 detects the near-end state of the lubricant, the lubricant is wasted. Furthermore, if the image forming operation is prohibited after detection of the near-end state, downtime of the apparatus is caused until the solid lubricant is replaced. To address this, in the present embodiment, the control unit 100 monitors the rotating distance (the number of times of rotation) of the applying roller 3*a* and the number of times of the image forming operation after the residual detecting unit detects the near-end state. If the rotating distance of the applying roller 3*a* and the number of times of the image forming operation become respective predetermined values, the control unit 100 determines that the lubricant is in the end state and prohibits the image forming operation.

As described above, in the present embodiment, even if the residual amount detecting mechanism 40 detects the near-end state, an image forming operation can be performed from when the user is prompted to replace the solid lubricant until the solid lubricant is prepared and the replacement starts. As a result, downtime of the apparatus can be suppressed. Furthermore, because the solid lubricant can be used just before the solid lubricant runs out, waste of the lubricant can be eliminated.

To eliminate waste of the lubricant as much as possible, a threshold of the rotating distance of the applying roller 3*a* for determining the solid lubricant to be in the end state is preferably set at a threshold corresponding to the state just before the solid lubricant runs out. When the temperature or the humidity is low, however, the solid lubricant 3*b* is excessively scraped. As a result, the lubricant runs out before the rotating distance of the applying roller 3*a* reaches the threshold.

To address this, in the present embodiment, the threshold of the rotating distance of the applying roller 3*a* for determining the solid lubricant to be in the end state is changed based on the temperature and the humidity in the device.

Figure 14:
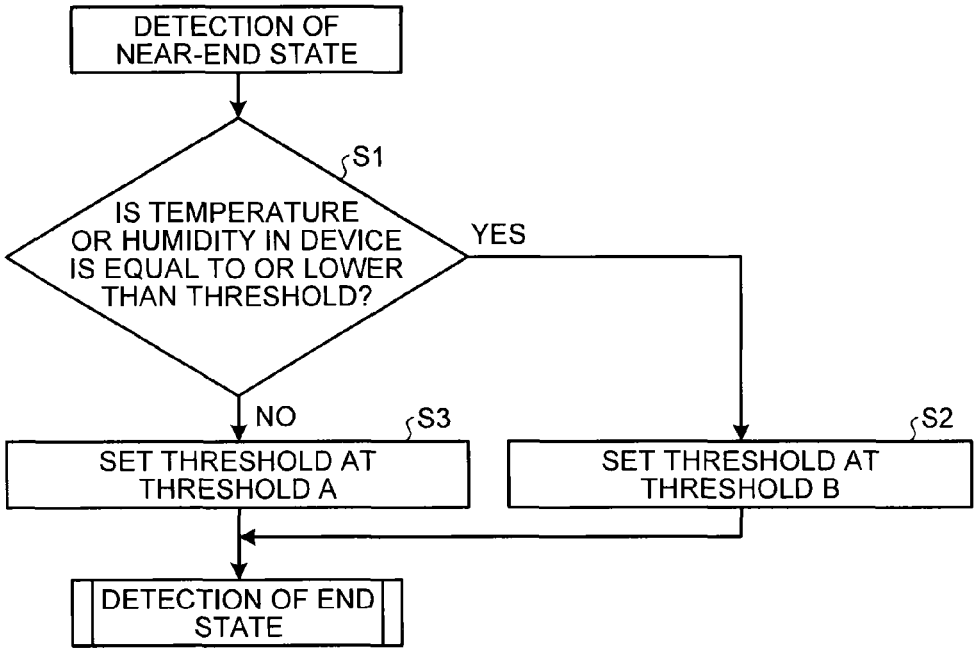
FIG. 14 is a control flowchart for detecting an end state.

FIG. 14 is a control flowchart for detecting the end state.

As illustrated in FIG. 14, if the residual amount detecting mechanism 40 detects the near-end state, the control unit 100 acquires temperature information and humidity information from a temperature sensor and a humidity sensor, which are not illustrated, respectively. If the temperature or the humidity in the device is equal to or lower than a preset threshold (Yes at Step S1), the control unit 100 sets the threshold of the rotating distance of the applying roller 3*a* used for detection of the end state at a threshold B (Step S2). By contrast, if the temperature or the humidity in the device exceeds the preset threshold (No at Step S1), the control unit 100 sets the threshold of the rotating distance of the applying roller 3*a* used for detection of the end state at a threshold A (Step S3). The threshold A is larger than the threshold B. Subsequently, the control unit monitors whether the rotating distance of the applying roller 3*a* reaches the threshold thus set. If the rotating distance reaches the threshold thus set, the control unit prohibits an image forming operation.

As described above, if the temperature or the humidity in the device is equal to or lower than the preset threshold, the threshold of the rotating distance of the applying roller 3*a* used for detection of the end state is set lower. Thus, it is possible to prevent running-out of the lubricant before the determination of the end state.

If the environment in the device is constant from detection of the near-end state to detection of the end state, the control flowchart described above can be employed. The temperature or the humidity in the device, however, may possibly drop below the threshold from detection of the near-end state to detection of the end state.

Figure 15:
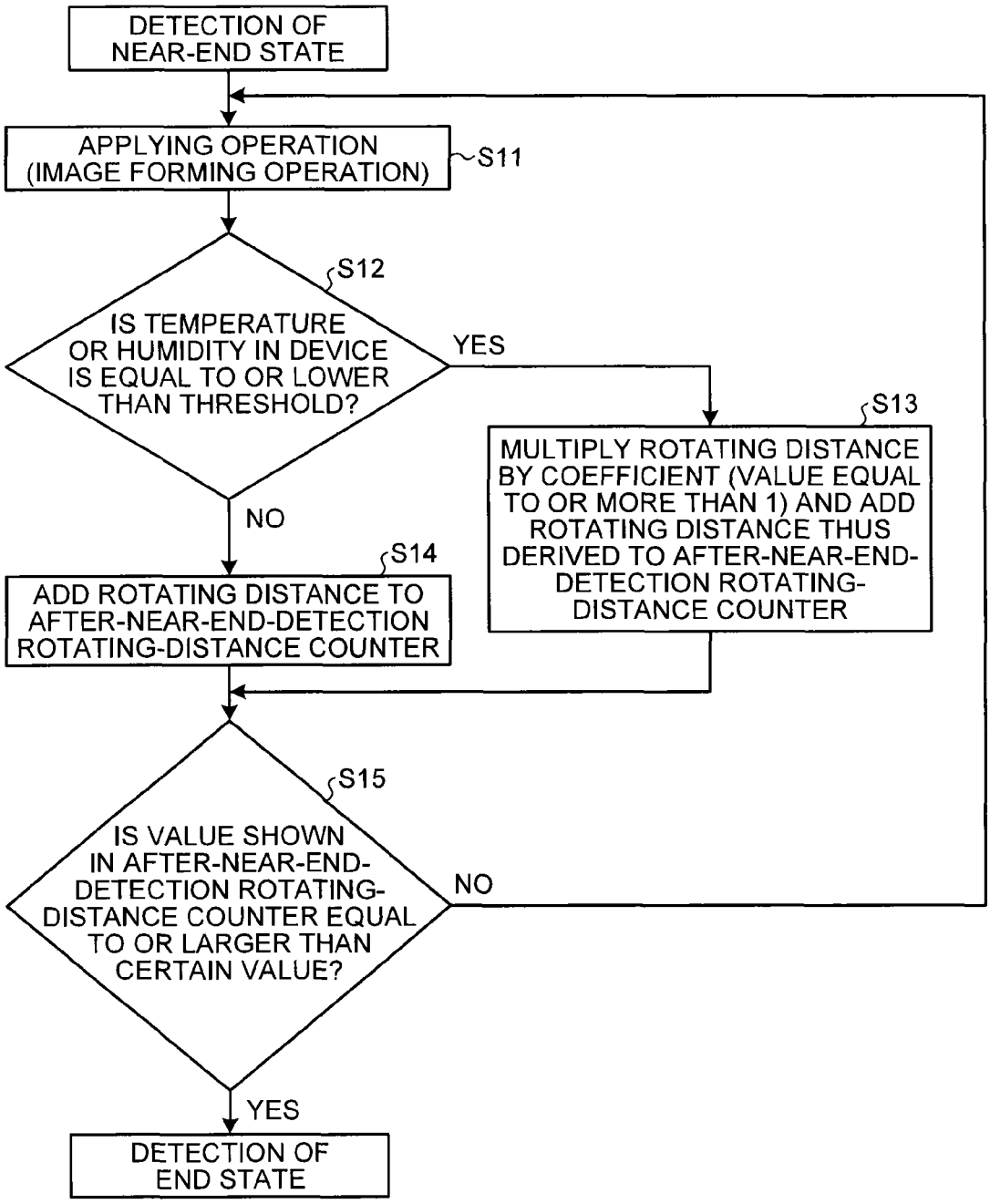
FIG. 15 is a control flowchart dealing with a case where the temperature or the humidity in the device drops below a threshold from detection of the near-end state to detection of the end state.

FIG. 15 is a control flowchart dealing with a case where the temperature or the humidity in the device drops below the threshold from the detection of the near-end state to the detection of the end state.

As illustrated in FIG. 15, if an applying operation (an image forming operation) is started after the near-end state is detected (Step S11), the control unit 100 starts to measure the rotating distance of the applying roller 3*a*. In addition, the control unit 100 acquires temperature information and humidity information from the temperature sensor and the humidity sensor, which are not illustrated, respectively. If the temperature or the humidity in the device is equal to or lower than the preset threshold (Yes at Step S12), the control unit 100 multiples the rotating distance of the applying roller 3*a* thus measured by a value of a coefficient of equal to or larger than 1 and adds the value thus derived to an after-near-end-detection rotating-distance counter after the applying operation (Step S13). By contrast, if the temperature or the humidity in the device exceeds the preset threshold (No at Step S12), the control unit 100 adds the rotating distance of the applying roller 3*a* thus measured to the after-near-end-detection rotating-distance counter after the applying operation (Step S14). Subsequently, the control unit 100 determines whether a value shown in the after-near-end-detection rotating-distance counter is equal to or larger than the value thus set. If the value is equal to or larger than the value thus set (Yes at Step S15), the control unit 100 determines that the lubricant is in the end state and prohibits an image forming operation.

As described above, the rotating distance of the applying roller 3*a* thus measured is weighted based on the temperature or the humidity in the device during an image forming operation (an applying operation). Therefore, even if the temperature or the humidity in the device drops below the threshold from detection of the near-end state to detection of the end state, the end state can be detected accurately.

A toner image formed on the surface of the photosensitive element to which the lubricant is applied is transferred onto the intermediate transfer belt 56 at the primary transfer portion. At this time, the lubricant on the surface of the photosensitive element may possibly be transferred onto the intermediate transfer belt together with the toner. Therefore, the amount of the lubricant on the surface of the photosensitive element is made smaller in formation of an image having a higher image area ratio than that in formation of an image having a lower image area ratio. As a result, the amount of the lubricant to be supplied to the surface of the photosensitive element is made larger in formation of an image having a higher image area ratio. Thus, if an image having a higher image area ratio is output, the lubricant is consumed more quickly, and the lubricant may possibly run out before the end state is detected. To address this, the rotating distance of the applying roller 3*a* thus measured may be weighted based on the image area ratio of an image to be formed.

Figure 16:
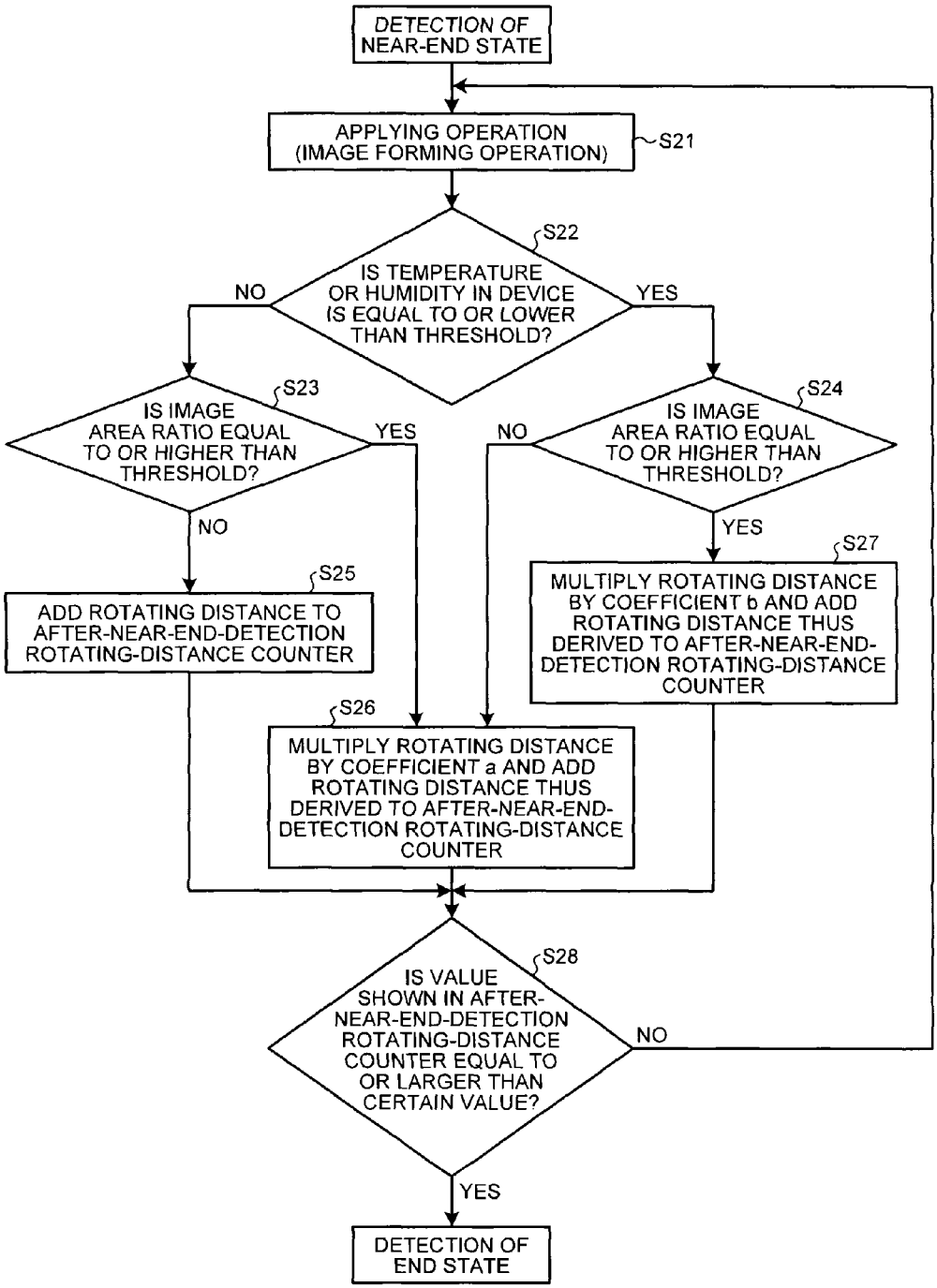
FIG. 16 is a control flowchart in further consideration of an image area ratio to the control illustrated in FIG. 15.

FIG. 16 is a control flowchart in further consideration of an image area ratio to the control flowchart illustrated in FIG. 15.

As illustrated in FIG. 16, if the temperature or the humidity in the device exceeds the preset threshold (No at Step S22) and if the image area ratio of a formed image is equal to or lower than a predetermined value (No at Step S23), the control unit 100 adds the rotating distance of the applying roller 3*a* thus measured to the after-near-end-detection rotating-distance counter (Step S25). If the temperature or the humidity in the device is equal to or lower than the threshold (Yes at Step S22) and if the image area ratio is equal to or lower than the threshold (No at Step S24) or if the temperature or the humidity in the device exceeds the threshold (No at Step S22) and if the image area ratio is equal to or higher than the threshold (Yes at Step S23), the control unit 100 multiples the rotating distance of the applying roller 3*a* thus measured by a coefficient a (a>1) and adds the value thus derived to the after-near-end-detection rotating-distance counter (Step 26). If the temperature or the humidity in the device is equal to or lower than the threshold (Yes at Step S22) and if the image area ratio is equal to or higher than the threshold (Yes at Step S24), the control unit 100 multiples the rotating distance of the applying roller 3*a* thus measured by a coefficient b (b>a>1) and adds the value thus derived to the after-near-end-detection rotating-distance counter (Step S27).

Thus, the end state can be detected more accurately. While the same weighting coefficient is used in the case where the temperature or the humidity in the device is equal to or lower than the threshold (Yes at Step S22) and the image area ratio is equal to or lower than the threshold (No at Step S24) and the case where the temperature or the humidity in the device exceeds the threshold (No at Step S22) and the image area ratio is equal to or higher than the threshold (Yes at Step S23) in FIG. 15, different weighting coefficients may be used. Furthermore, by subdividing the conditions of the temperature or the humidity in the device and the conditions of the image area ratio more minutely, for example, the conditions for the weighting on the rotating distance of the applying roller thus measured may be subdivided more minutely.

Instead of the rotating distance of the applying roller 3*a*, the end state of the lubricant may be detected by measuring rotating time of the applying roller 3*a*, for example.

Furthermore, by predicting a time period until the solid lubricant reaches the end state based on the consumption speed of the solid lubricant from the early period of use of the solid lubricant to detection of the near-end state, the end state of the solid lubricant may be detected. As described above, the consumption speed of the solid lubricant varies depending on the environment in which the image forming apparatus is used and an image to be printed (image area ratio), for example. However, it is hardly likely that the use environment and the usage of the apparatus from detection of the near-end state of the solid lubricant to detection of the end state significantly change from the use environment and the usage from the early period of use of the solid lubricant to the detection of the near-end state. Therefore, the consumption speed of the solid lubricant from the early period of use of the solid lubricant to the detection of the near-end state is nearly equal to the consumption speed of the solid lubricant from the detection of the near-end state of the solid lubricant to the detection of the end state. Accordingly, the time period until the solid lubricant reaches the end state can be predicted reliably based on the consumption speed of the solid lubricant from the early period of use of the solid lubricant to the detection of the near-end state.

Figure 17:
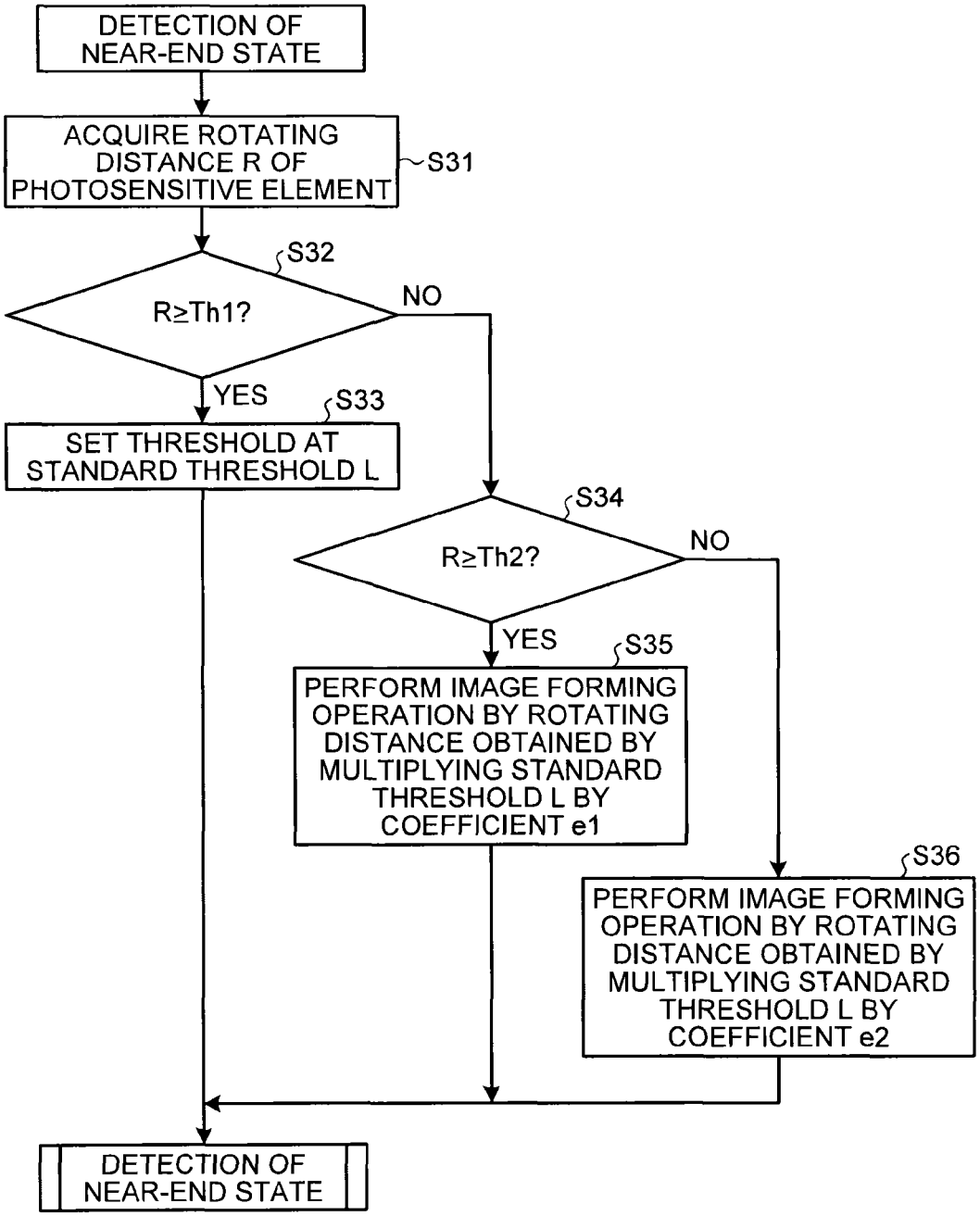
FIG. 17 is a control flowchart for setting a threshold for detection of the end state based on consumption speed of the solid lubricant from the early period of use of the solid lubricant to detection of the near-end state.

FIG. 17 is a control flowchart for setting a threshold for detection of the end state based on the consumption speed of the solid lubricant from the early period of use of the solid lubricant to detection of the near-end state. While the rotating distance of the photosensitive element is used for detection of the end state in the example of FIG. 17, the rotating distance of the applying roller, the number of times of the image forming operation, and other factors may be used for detection of the end state.

As illustrated in FIG. 17, if the residual amount detecting mechanism 40 detects the near-end state, the control unit 100 acquires a rotating distance R of the photosensitive element 1 from the early period of use of the solid lubricant to the detection of the near-end state as the consumption speed of the solid lubricant from the early period of use of the solid lubricant to the detection of the near-end state (Step S31). If the rotating distance R of the photosensitive element 1 is equal to or larger than a first threshold Th1 (Yes at Step S32), the control unit 100 sets the threshold of the rotating distance of the photosensitive element used for detection of the end state at a standard threshold L (Step S33). By contrast, if the rotating distance R of the photosensitive element 1 is smaller than the first threshold Th1 and equal to or larger than a second threshold Th2 (No at Step S32 and Yes at Step S34), the control unit 100 sets a threshold obtained by multiplying the standard threshold L by a coefficient e1 (1>e1) to the threshold of the rotating distance of the photosensitive element used for detection of the end state (Step S35). If the rotating distance R of the photosensitive element 1 is smaller than the second threshold Th2 (No at Step S32 and No at Step S34), the control unit 100 sets a threshold obtained by multiplying the standard threshold L by a coefficient e2 (1>e1>e2) to the threshold of the rotating distance of the photosensitive element used for detection of the end state (Step S36). Subsequently, the control unit 100 monitors whether the rotating distance of the applying roller 3*a* reaches the threshold thus set. If the rotating distance reaches the threshold thus set, the control unit 100 prohibits an image forming operation.

Figure 18:
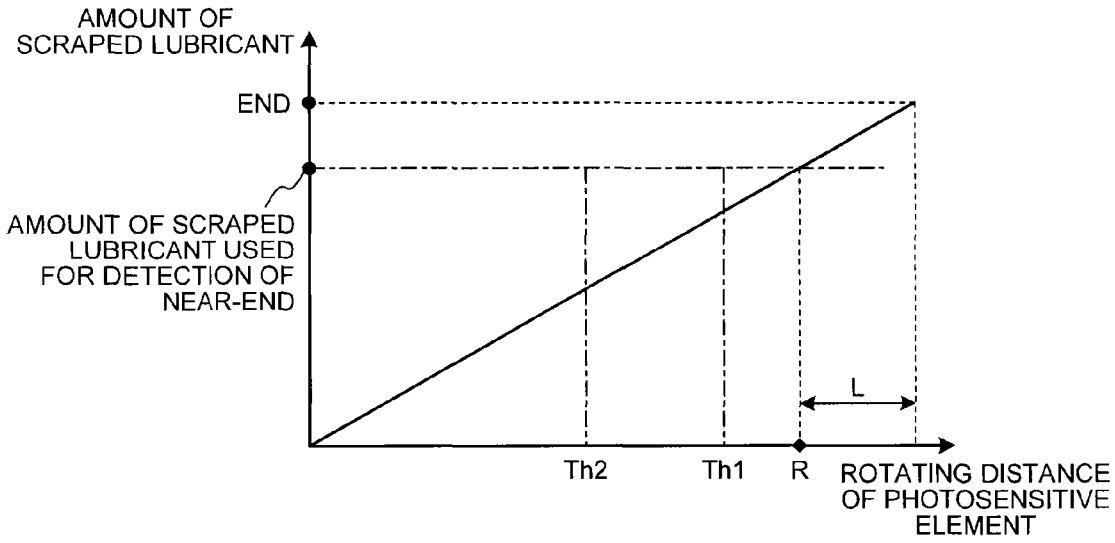
FIG. 18 is a graph of a relationship between the rotating distance of a photosensitive element and the total amount of a scraped lubricant in standard usage.

FIG. 18 is a graph of a relationship between the rotating distance of the photosensitive element and the total amount of the scraped lubricant in standard usage in which the apparatus is used in air-conditioning environment, such as an office, and images composed mostly of characters (images having a lower image area ratio) are mainly printed. In the standard usage, the rotating distance R of the photosensitive element 1 from the early period of use of the solid lubricant 3*b* to detection of the near-end state is equal to or larger than the first threshold Th1. In this case, when the rotating distance of the photosensitive element reaches L after the detection of the near-end state, the lubricant reaches the end state. Thus, the threshold of the rotating distance of the photosensitive element 1 used for detection of the end state is set at the standard threshold L. The threshold L thus set when the rotating distance R of the photosensitive element is equal to or larger than Th1 is a rotating distance of the photosensitive element from the near-end state to the end state at lubricant consumption speed (inclination of a line illustrated in FIG. 18) employed when the rotating distance R of the photosensitive element is equal to Th1.

Figure 19:
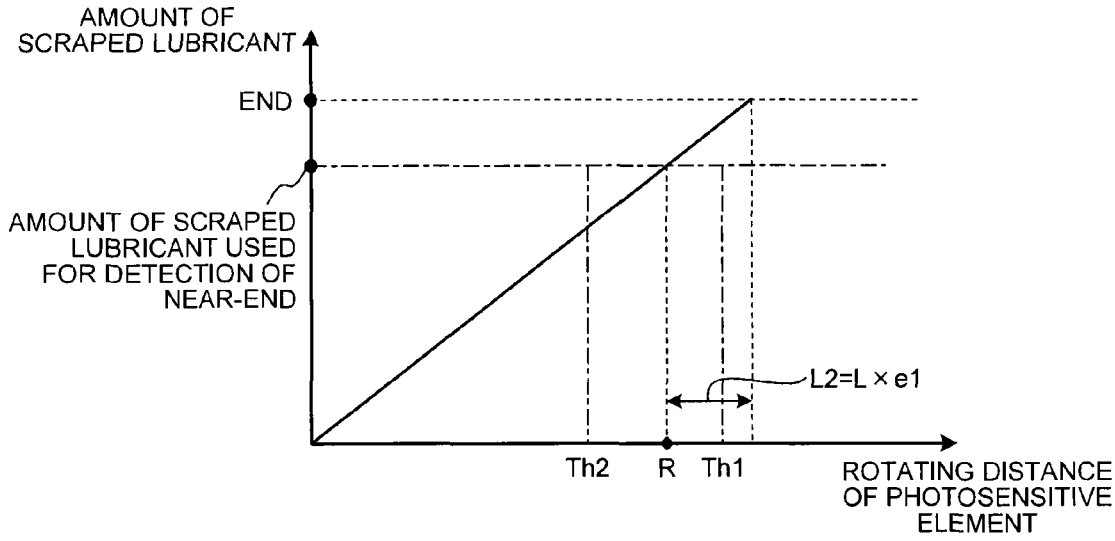
FIG. 19 is a graph of a relationship between the rotating distance of the photosensitive element and the total amount of a scraped lubricant in relatively hard usage.

FIG. 19 is a graph of a relationship between the rotating distance of the photosensitive element and the total amount of the scraped lubricant in relatively hard usage in which the apparatus is used under low-temperature or low-humidity environment or in which images having a higher image area ratio, such as photos, are mainly printed.

As illustrated in FIG. 19, the lubricant consumption speed (the amount of the scraped lubricant per unit rotating distance of the photosensitive element: inclination of the graph) in the relatively hard usage is faster than that in the standard usage illustrated in FIG. 18. As a result, the rotating distance R of the photosensitive element 1 from the early period of use of the solid lubricant 3*b* to the near-end state is shorter than that in the standard usage illustrated in FIG. 18 and is a value smaller than the first threshold Th1 and equal to and larger than the second threshold Th2. Furthermore, a rotating distance L2 of the photosensitive element from the detection of the near-end state to the end state of the lubricant in the relatively hard usage is shorter than the rotating distance L in the standard usage illustrated in FIG. 18. Therefore, if the threshold of the rotating distance of the photosensitive element 1 used for detection of the end state in the relatively hard usage is set at the standard threshold L, the rotating distance of the photosensitive element 1 does not reach the threshold L despite the end state of the lubricant, whereby the end state fails to be detected. To address this, by setting the threshold of the rotating distance of the photosensitive element 1 used for detection of the end state in the relatively hard usage at L2=L×e1 (e1<1) shorter than the standard threshold L, the end state of the solid lubricant can be detected reliably. The threshold L2 thus set when the rotating distance R of the photosensitive element is smaller than Th1 and equal to or larger than Th2 is a rotating distance of the photosensitive element from the near-end state to the end state at the lubricant consumption speed (inclination of a line illustrated in FIG. 19) employed when the rotating distance R of the photosensitive element is equal to Th2.

Figure 20:
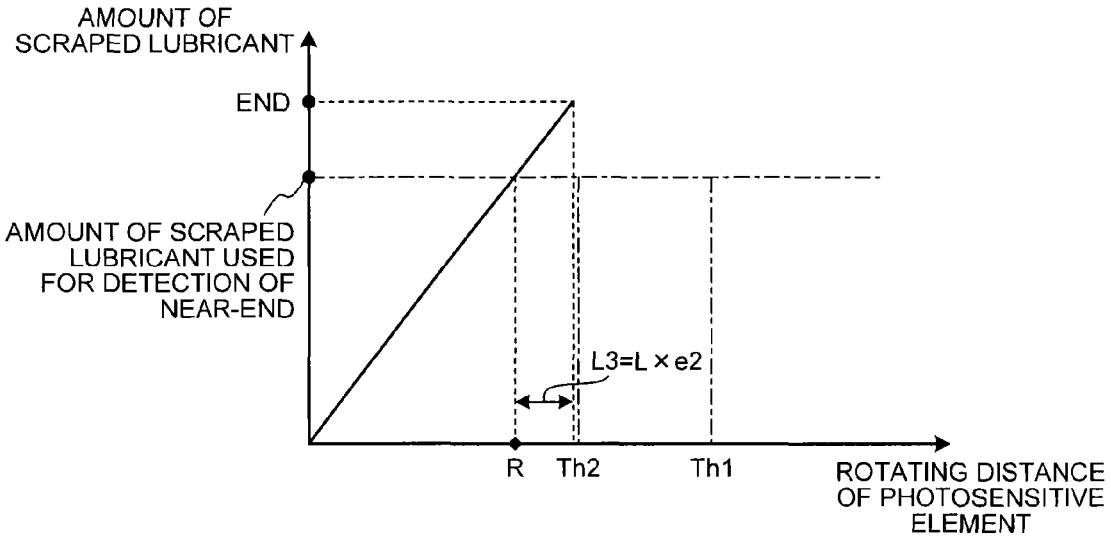
FIG. 20 is a graph of a relationship between the rotating distance of the photosensitive element and the total amount of a scraped lubricant in extremely hard usage.

FIG. 20 is a graph of a relationship between the rotating distance of the photosensitive element and the total amount of the scraped lubricant in extremely hard usage in which the apparatus is used under extremely low-temperature or extremely low-humidity environment or in which images having an extremely higher image area ratio, such as solid images, continue to be printed.

As illustrated in FIG. 20, the lubricant consumption speed (the amount of the scraped lubricant per unit rotating distance of the photosensitive element: inclination of the graph) in the extremely hard usage is significantly faster than that in the standard usage illustrated in FIG. 18. As a result, the rotating distance R of the photosensitive element 1 from the early period of use of the solid lubricant 3*b* to the near-end state is significantly shorter than that in the standard usage illustrated in FIG. 18 and is a value smaller than the second threshold Th2. Furthermore, a rotating distance L3 of the photosensitive element from the detection of the near-end state to the end state of the lubricant in the extremely hard usage is significantly shorter than the rotating distance L in the standard usage illustrated in FIG. 18. Therefore, by setting the threshold of the rotating distance of the photosensitive element 1 used for detection of the end state in the extremely hard usage at L3=L×e2 (e2<e1<1) significantly shorter than the standard threshold L, the end state of the solid lubricant can be detected reliably.

The lubricant consumption speed from the early period of use of the solid lubricant to the detection of the near-end state is figured out based on the rotating distance R of the photosensitive element. Alternatively, the lubricant consumption speed may be figured out based on the rotating distance of the applying roller 3*a* or the number of times of the image forming operation.

Furthermore, as illustrated in FIG. 15 and FIG. 16, the threshold for detection of the end state set based on the lubricant consumption speed from the early period of use of the solid lubricant to the detection of the near-end state may be changed depending on change in the environment in the device from the detection of the near-end state to the detection of the end state and on the image area ratio of an image to be printed.

The residual amount detecting mechanism 40 is given just as an example, and the residual amount detecting mechanism 40 may include an electrode member provided to the side surface of the storage case and a lubricant holding member formed of a conductive member, for example. If the lubricant holding member moves to a predetermined position on the applying roller 3*a* side, the electrode member and the lubricant holding member may establish electrical continuity therebetween. Alternatively, the residual amount detecting mechanism 40 may be formed of a push switch and a pressing member pressing the push switch, and the pressing member may press the push switch when the lubricant reaches the near-end state. Still alternatively, the residual amount detecting mechanism 40 may detect the near-end state of the solid lubricant 3*b* with a photo-interrupter or a photo-reflector.

The embodiment described above is given just as an example, and the present invention has advantageous effects specific to each of the following aspects (1) to (11).

(1)

A lubricant supplying device includes: the solid lubricant 3*b*; a supplying member, such as the applying roller 3*a*, that comes into contact with the solid lubricant 3*b* and supplies a lubricant scraped off by rubbing the solid lubricant 3*b* to a target to be supplied with the lubricant; a residual amount detecting unit, such as the residual amount detecting mechanism 40, that detects that the residual amount of the solid lubricant is equal to or smaller than a predetermined amount by detecting that the length of the solid lubricant 3*b* in a direction in which the solid lubricant 3*b* moves while being scraped by the supplying member is equal to or smaller than a predetermined value; and a lubricant end determining unit (the control unit 100 in the present embodiment) that determines that the solid lubricant is in the end state when the amount of a lubricant supplying operation reaches a threshold after the residual amount detecting unit detects that the residual amount of the solid lubricant is equal to or smaller than the predetermined amount. The lubricant end determining unit makes a threshold of the amount of the lubricant supplying operation at temperature or humidity of equal to or lower than a predetermined value lower than a threshold of the amount of the lubricant supplying operation at temperature or humidity of higher than the predetermined value. This configuration makes it possible to prevent running-out of the lubricant at temperature or humidity of equal to or lower than the predetermined value as described above in the embodiment.

(2)

A lubricant supplying device includes: the solid lubricant 3*b*; a supplying member, such as the applying roller 3*a*, that comes into contact with the solid lubricant 3*b* and supplies a lubricant scraped off by rubbing the solid lubricant 3*b* to a target to be supplied with the lubricant; a residual amount detecting unit, such as the residual amount detecting mechanism 40, that detects that the residual amount of the solid lubricant is equal to or smaller than a predetermined amount by detecting that the length of the solid lubricant 3*b* in a direction in which the solid lubricant 3*b* moves while being scraped by the supplying member is equal to or smaller than a predetermined value; a lubricant end determining unit (the control unit 100 in the present embodiment) that determines that the solid lubricant is in the end state when the amount of a lubricant supplying operation reaches a threshold after the residual amount detecting unit detects that the residual amount of the solid lubricant is equal to or smaller than the predetermined amount; and a threshold setting unit (the control unit 100 in the present embodiment) that sets the threshold of the amount of the lubricant supplying operation based on consumption speed of the solid lubricant 3*b* from an early period of use of the solid lubricant 3*b* until the residual amount detecting unit detects that the residual amount of the solid lubricant 3*b* is equal to or smaller than the predetermined amount.

In this configuration, it is hardly unlikely that the use environment and the usage significantly change before and after detection of the near-end state as explained with reference to FIG. 17 to FIG. 20. Therefore, the consumption speed of the lubricant after the detection of the near-end state is nearly equal to the consumption speed of the lubricant before the detection of the near-end state. Thus, by setting the threshold of the amount of the lubricant supplying operation based on the consumption speed of the solid lubricant 3*b* from the early period of use of the solid lubricant 3*b* until the residual amount detecting unit detects that the residual amount of the solid lubricant 3*b* is equal to or smaller than the predetermined amount, the lubricant end determining unit can detect the end state when the solid lubricant is nearly in the end state.

(3)

The lubricant supplying device 3 in the aspect (1) includes a threshold setting unit that sets the threshold of the amount of the lubricant supplying operation based on consumption speed of the solid lubricant 3*b* from an early period of use of the solid lubricant 3*b* until the residual amount detecting unit detects that the residual amount of the solid lubricant 3*b* is equal to or smaller than the predetermined amount.

This configuration makes it possible to set a threshold suitable for the usage of the device, thereby achieving reliable detection of the end state.

(4)

In the lubricant supplying device 3 in the aspect (2) or (3), the threshold setting unit sets the threshold lower as the consumption speed of the solid lubricant is faster.

This configuration makes it possible to set a threshold suitable for the usage of the device, thereby achieving reliable detection of the end state.

(5)

In the lubricant supplying device in any one of the aspects (1) to (4), the rotating distance of the supplying member is used as the amount of the lubricant supplying operation.

This configuration makes it possible to predict the consumption amount of the lubricant accurately.

(6)

In the lubricant supplying device in any one of the aspects (1) to (5), a driving unit that drives to rotate the supplying member is provided, and the rotation rate of the supplying member is increased over time.

This configuration makes it possible to reduce the lubricant consumption rate at the early period of use, thereby realizing a stable lubricant consumption rate over time.

(7)

In the lubricant supplying device in any one of the aspects (1) to (6), a urethane foam roller is used as the supplying member.

This configuration makes it possible to reduce the lubricant consumption rate at the early period of use compared with the case where a brush roller is used as the supplying member as described above in the embodiment.

(8)

In the lubricant supplying device in any one of the aspects (1) to (7), the pressing mechanism 3*c* includes the pair of swinging members 31*a* supported in a swingable manner in a storage case and a biasing unit, such as the spring 31*b*, that biases the pair of swinging members 31*a*. The biasing force of the biasing unit causes the pair of swinging members 31*a* to press the solid lubricant 3*b* against the supplying member. The pair of swinging members 31*a* have a shape with which the pressing force applied to the solid lubricant 3*b* at the early period of use of the solid lubricant is lower than the pressing force applied to the solid lubricant 3*b* after the solid lubricant 3*b* is consumed by a predetermined amount.

This configuration makes it possible to reduce the lubricant consumption rate at the early period of use as described above in the embodiment, thereby increasing the life of the solid lubricant.

(9)

In an image forming apparatus including an image carrier, such as the photosensitive element 1, and a lubricant supplying unit that supplies a lubricant to the surface of the image carrier and transferring an image formed on the image carrier eventually onto a recording medium to form the image on the recording medium, the lubricant supplying device in any one of the aspects (1) to (8) is used as the lubricant supplying unit.

With this configuration, it is possible to suppress waste of the lubricant. In addition, it is possible to prevent an image forming operation when the lubricant runs out. Thus, deterioration of the photosensitive element can be reduced over time.

(10)

In the image forming apparatus in the aspect (9), the lubricant end determining unit changes the threshold of the amount of the lubricant supplying operation based on the image area ratio of an image formed after the residual amount detecting unit detects that the residual amount of the solid lubricant is equal to or smaller than the predetermined amount.

This configuration makes it possible to detect the end state of the lubricant accurately as explained with reference to FIG. 16.

(11)

In the image forming apparatus in the aspect (9) or (10), the threshold setting unit figures out the consumption speed of the solid lubricant based on the rotating distance of the image carrier from an early period of use of the solid lubricant until the residual amount detecting unit detects that the residual amount of the solid lubricant is equal to or smaller than the predetermined amount.

This configuration makes it possible to figure out the consumption speed of the solid lubricant reliably.

(12)

In a process cartridge including an image carrier, such as the photosensitive element 1, and a lubricant supplying unit that supplies a lubricant to the surface of the image carrier and being configured in a manner attachable to and detachable from an image forming apparatus main body, the lubricant supplying device according to any one of the aspects (1) to (8) is used as the lubricant supplying unit.

With this configuration, it is possible to suppress waste of the lubricant. In addition, it is possible to prevent an image forming operation when the lubricant runs out. Thus, deterioration of the photosensitive element can be reduced over time.

The present invention includes the lubricant end determining unit that determines that the solid lubricant is in the end state when the amount of the lubricant supplying operation reaches the threshold after the residual amount detecting unit detects that the residual amount of the solid lubricant is equal to or smaller than the predetermined amount. As a result, the solid lubricant can be used to nearly the end of the lubricant, whereby waste of the lubricant can be suppressed.

Furthermore, the present invention makes a threshold of the amount of the lubricant supplying operation at temperature or humidity of equal to or lower than a predetermined value lower than a threshold of the amount of the lubricant supplying operation at temperature or humidity of higher than the predetermined value. As a result, it is possible to prevent running-out of the lubricant at temperature or humidity of equal to or lower than the predetermined value.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lubricant supplying device comprising:

a solid lubricant;

a supplying member that comes into contact with the solid lubricant and supplies a lubricant scraped off by rubbing the solid lubricant to a target to be supplied with the lubricant;

a residual amount detecting unit that detects that a residual amount of the solid lubricant is equal to or smaller than a predetermined amount by detecting that the length of the solid lubricant in a direction in which the solid lubricant moves while being scraped by the supplying member is equal to or smaller than a predetermined value; and a lubricant end determining unit that determines that the solid lubricant is in an end state when the amount of a lubricant supplying operation reaches a threshold after the residual amount detecting unit detects that the residual amount of the solid lubricant is equal to or smaller than the predetermined amount, wherein the lubricant end determining unit makes a threshold of the amount of the lubricant supplying operation at temperature or humidity of equal to or lower than a predetermined value lower than a threshold of the amount of the lubricant supplying operation at temperature or humidity of higher than the predetermined value.

2. The lubricant supplying device according to claim 1, further comprising a threshold setting unit that sets the threshold of the amount of the lubricant supplying operation based on consumption speed of the solid lubricant from an early period of use of the solid lubricant until the residual amount detecting unit detects that the residual amount of the solid lubricant is equal to or smaller than the predetermined amount.

3. The lubricant supplying device according to claim 2, wherein the threshold setting unit sets the threshold lower as the consumption speed of the solid lubricant is faster.

4. The lubricant supplying device according to claim 1, wherein a rotating distance of the supplying member is used as the amount of the lubricant supplying operation.

5. The lubricant supplying device according to claim 1, further comprising:

a driving unit that drives to rotate the supplying member, wherein a rotation rate of the supplying member is increased over time.

6. The lubricant supplying device according to claim 1, wherein a urethane foam roller is used as the supplying member.

7. The lubricant supplying device according to claim 1, further comprising a pressing mechanism configured to comprise a pair of swinging members supported in a swingable manner in a storage case and a biasing unit that biases the pair of swinging members, wherein biasing force of the biasing unit causes the swinging members to press the solid lubricant against the supplying member, and the swinging members have a shape with which pressing force applied to the solid lubricant at the early period of use of the solid lubricant is lower than pressing force applied to the solid lubricant after the solid lubricant is consumed by a predetermined amount.

8. A lubricant supplying device comprising:

a solid lubricant;

a supplying member that comes into contact with the solid lubricant and supplies a lubricant scraped off by rubbing the solid lubricant to a target to be supplied with the lubricant;

a residual amount detecting unit that detects that a residual amount of the solid lubricant is equal to or smaller than a predetermined amount by detecting that the length of the solid lubricant in a direction in which the solid lubricant moves while being scraped by the supplying member is equal to or smaller than a predetermined value;

a lubricant end determining unit that determines that the solid lubricant is in an end state when the amount of a lubricant supplying operation reaches a threshold after the residual amount detecting unit detects that the residual amount of the solid lubricant is equal to or smaller than the predetermined amount; and a threshold setting unit that sets the threshold of the amount of the lubricant supplying operation based on consumption speed of the solid lubricant from an early period of use of the solid lubricant until the residual amount detecting unit detects that the residual amount of the solid lubricant is equal to or smaller than the predetermined amount.

9. The lubricant supplying device according to claim 8, wherein the threshold setting unit sets the threshold lower as the consumption speed of the solid lubricant is faster.

10. The lubricant supplying device according to claim 8, wherein a rotating distance of the supplying member is used as the amount of the lubricant supplying operation.

11. The lubricant supplying device according to claim 8, further comprising:

a driving unit that drives to rotate the supplying member, wherein a rotation rate of the supplying member is increased over time.

12. The lubricant supplying device according to claim 8, wherein a urethane foam roller is used as the supplying member.

13. The lubricant supplying device according to claim 8, further comprising a pressing mechanism configured to comprise a pair of swinging members supported in a swingable manner in a storage case and a biasing unit that biases the pair of swinging members, wherein biasing force of the biasing unit causes the swinging members to press the solid lubricant against the supplying member, and the swinging members have a shape with which pressing force applied to the solid lubricant at the early period of use of the solid lubricant is lower than pressing force applied to the solid lubricant after the solid lubricant is consumed by a predetermined amount.

14. An image forming apparatus comprising:

an image carrier; and a lubricant supplying unit that supplies a lubricant to a surface of the image carrier, the image forming apparatus transferring an image formed on the image carrier eventually onto a recording medium to form the image on the recording medium, wherein the lubricant supplying device comprises;

a solid lubricant, a supplying member that comes into contact with the solid lubricant and supplies a lubricant scraped off by rubbing the solid lubricant to a target to be supplied with the lubricant, a residual amount detecting unit that detects that a residual amount of the solid lubricant is equal to or smaller than a predetermined amount by detecting that the length of the solid lubricant in a direction in which the solid lubricant moves while being scraped by the supplying member is equal to or smaller than a predetermined value, and a lubricant end determining unit that determines that the solid lubricant is in an end state when the amount of a lubricant supplying operation reaches a threshold after the residual amount detecting unit detects that the residual amount of the solid lubricant is equal to or smaller than the predetermined amount, wherein the lubricant end determining unit makes a threshold of the amount of the lubricant supplying operation at temperature or humidity of equal to or lower than a predetermined value lower than a threshold of the amount of the lubricant supplying operation at temperature or humidity of higher than the predetermined value.

15. The image forming apparatus according to claim 14, wherein the lubricant end determining unit changes the threshold of the amount of the lubricant supplying operation based on an image area ratio of an image formed after the residual amount detecting unit detects that the residual amount of the solid lubricant is equal to or smaller than the predetermined amount.

16. The image forming apparatus according to claim 14, further comprising a threshold setting unit that figures out the consumption speed of a solid lubricant based on a rotating distance of the image carrier from an early period of use of the solid lubricant until the residual amount detecting unit detects that the residual amount of the solid lubricant is equal to or smaller than the predetermined amount.

17. An image forming apparatus comprising:

an image carrier; and a lubricant supplying unit that supplies a lubricant to a surface of the image carrier, the image forming apparatus transferring an image formed on the image carrier eventually onto a recording medium to form the image on the recording medium, wherein the lubricant supplying device comprises;

a solid lubricant, a supplying member that comes into contact with the solid lubricant and supplies a lubricant scraped off by rubbing the solid lubricant to a target to be supplied with the lubricant, a residual amount detecting unit that detects that a residual amount of the solid lubricant is equal to or smaller than a predetermined amount by detecting that the length of the solid lubricant in a direction in which the solid lubricant moves while being scraped by the supplying member is equal to or smaller than a predetermined value, a lubricant end determining unit that determines that the solid lubricant is in an end state when the amount of a lubricant supplying operation reaches a threshold after the residual amount detecting unit detects that the residual amount of the solid lubricant is equal to or smaller than the predetermined amount; and a threshold setting unit that sets the threshold of the amount of the lubricant supplying operation based on consumption speed of the solid lubricant from an early period of use of the solid lubricant until the residual amount detecting unit detects that the residual amount of the solid lubricant is equal to or smaller than the predetermined amount.

18. The image forming apparatus according to claim 17, wherein the lubricant end determining unit changes the threshold of the amount of the lubricant supplying operation based on an image area ratio of an image formed after the residual amount detecting unit detects that the residual amount of the solid lubricant is equal to or smaller than the predetermined amount.

19. The image forming apparatus according to claim 17, wherein the threshold setting unit figures out the consumption speed of the solid lubricant based on a rotating distance of the image carrier from an early period of use of the solid lubricant until the residual amount detecting unit detects that the residual amount of the solid lubricant is equal to or smaller than the predetermined amount.

* * * * *